US011532904B2

(12) United States Patent
Amemori et al.

(10) Patent No.: US 11,532,904 B2
(45) Date of Patent: Dec. 20, 2022

(54) ELECTRICAL CONNECTOR SET AND CIRCUIT BOARD ON WHICH ELECTRICAL CONNECTOR SET IS MOUNTED

(71) Applicant: Murata Manufacturing Co., Ltd., Kyoto-fu (JP)

(72) Inventors: Yuma Amemori, Nagaokakyo (JP); Hiroyuki Hoshiba, Nagaokakyo (JP); Aoi Tanaka, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 17/183,044

(22) Filed: Feb. 23, 2021

(65) Prior Publication Data

US 2021/0175649 A1 Jun. 10, 2021

Related U.S. Application Data

(63) Continuation of application No. PCT/JP2019/019290, filed on May 15, 2019.

(30) Foreign Application Priority Data

Aug. 24, 2018 (JP) ..... JP2018-157578

(51) Int. Cl.
*H01R 12/71* (2011.01)
*H01R 12/70* (2011.01)
(Continued)

(52) U.S. Cl.
CPC ..... *H01R 12/716* (2013.01); *H01R 12/7005* (2013.01); *H01R 13/6594* (2013.01);
(Continued)

(58) Field of Classification Search
CPC ..... H01R 12/716; H01R 12/7005; H01R 13/6594; H01R 13/6596; H01R 13/20; H01R 12/712; H01R 12/73; H01R 12/71
See application file for complete search history.

(56) References Cited

U.S. PATENT DOCUMENTS

2006/0141811 A1* 6/2006 Shichida ..... H01R 24/50 439/63

FOREIGN PATENT DOCUMENTS

CN 1797868 A 7/2006
JP 2553012 B2 11/1996
(Continued)

OTHER PUBLICATIONS

An Office Action mailed by China National Intellectual Property Administration dated Jan. 30, 2022, which corresponds to Chinese Patent Application No. 201980055349.6 and is related to U.S. Appl. No. 17/183,044 with English language translation.
(Continued)

*Primary Examiner* — Abdullah A Riyami
*Assistant Examiner* — Justin M Kratt
(74) *Attorney, Agent, or Firm* — Studebaker & Brackett PC

(57) ABSTRACT

An electrical connector set includes first and second connectors, in which the first connector has a first connection terminal, a first high-frequency connection terminal transmitting a high frequency signal, and a first external grounding member surrounding the first high-frequency connection terminal, the second connector has a second connection terminal, a second high-frequency connection terminal, and a second external grounding member surrounding the second high-frequency connection terminal. At a time of fitting, the second external grounding member is located on an inner side of the first external grounding member, the first and
(Continued)

second connection terminals are located on an outer side of the first external grounding member, the second external grounding member is closed in a peripheral shape to surround the first and second high-frequency connection terminals, and first and second mounting parts are located on an inner side of the second external grounding member.

20 Claims, 23 Drawing Sheets

(51) Int. Cl.

| | |
|---|---|
| ***H01R 13/6594*** | (2011.01) |
| ***H01R 13/6596*** | (2011.01) |
| *H01R 13/20* | (2006.01) |
| *H01R 12/73* | (2011.01) |

(52) U.S. Cl.
CPC ..... *H01R 13/6596* (2013.01); *H01R 12/71* (2013.01); *H01R 12/712* (2013.01); *H01R 12/73* (2013.01); *H01R 13/20* (2013.01)

(56) References Cited

FOREIGN PATENT DOCUMENTS

| | | | | |
|---|---|---|---|---|
| JP | 2000-500607 | A | 1/2000 | |
| JP | 3086881 | U | 7/2002 | |
| JP | 2006-185773 | A | 7/2006 | |
| JP | 2016-085994 | A | 5/2016 | |
| WO | 2017053149 | A1 | 3/2017 | |
| WO | WO-2017053149 | A1 * | 3/2017 | ..... H01R 12/732 |

OTHER PUBLICATIONS

International Search Report issued in PCT/JP2019/019290; dated Aug. 6, 2019.
International Preliminary Report on Patentability and Written Opinion issued in PCT/JP2019/019290; dated Mar. 2, 2021.

* cited by examiner

ELECTRICAL CONNECTOR SET AND CIRCUIT BOARD ON WHICH ELECTRICAL CONNECTOR SET IS MOUNTED

CROSS-REFERENCE TO RELATED APPLICATIONS

This application claims benefit of priority to International Patent Application No. PCT/JP2019/019290, filed May 15, 2019, and to Japanese Patent Application No. 2018-157578, filed Aug. 24, 2018, the entire contents of each are incorporated herein by reference.

BACKGROUND

Technical Field

The present disclosure relates to an electrical connector set in which a first connector and a second connector are fitted to each other, and a circuit board on which the electrical connector set is mounted.

Background Art

For example, Japanese Patent Application Laid-Open No. 2016-85994 discloses that a first reinforcing metal fittings are disposed at both ends of a first connector and second reinforcing metal fittings fitted to the first reinforcing metal fittings are disposed at both ends of a second connector such that the first connector having a multi-pole connection terminal and the second connector having a mating connection terminal engaging the connection terminal can be accurately fitted to each other. The first reinforcing metal fittings and the second reinforcing metal fittings include a metal material and have a U-shaped open shape that is not continuously connected in a plan view. Therefore, the first reinforcing metal fittings and the second reinforcing metal fittings are intended for accurate fitting, and do not provide electromagnetically high shielding property.

SUMMARY

In a connector set having a multi-pole connection terminal, signals transmitted by the connection terminal have an increasingly higher frequency. When the connector set having a multi-pole connection terminal is used for transmitting high frequency signals, a ground terminal and a board on which the connector set is mounted located near the connection terminal transmitting the high frequency signals are likely to cause resonance and generate radiation noise due to an electromagnetic field radiated from the connection terminal transmitting the high frequency signals, thereby hindering stable signal transmission in a transmission band.

Therefore, the present disclosure provides an electrical connector set in which a connection terminal transmitting a high frequency signal can stably transmit a signal in a transmission band.

Accordingly, an electrical connector set according to one aspect of the present disclosure includes a first connector mounted on a first circuit board, and a second connector mounted on a second circuit board and extractably fitted to the first connector in an insertion-extraction direction, in which the first connector has a first connection terminal, a first high-frequency connection terminal having a first mounting part mounting on the first circuit board and transmitting a high frequency signal having a frequency higher than a signal transmitted by the first connection terminal, and a first external grounding member that is a conductor connected to a ground potential and surrounds the first high-frequency connection terminal. The second connector has a second connection terminal electrically connected to the first connection terminal at a time of fitting, a second high-frequency connection terminal having a second mounting part mounting on the second circuit board and electrically connected to the first high-frequency connection terminal at the time of fitting, and a second external grounding member that is a conductor connected to the ground potential, surrounds the second high-frequency connection terminal, and is electrically connected to the first external grounding member at the time of fitting. When the first connector and the second connector are fitted to each other, in a plan view from the insertion-extraction direction, the second external grounding member is located on an inner side of the first external grounding member, the first connection terminal and the second connection terminal are located on an outer side of the first external grounding member, the second external grounding member is closed in a peripheral shape so as to surround the first high-frequency connection terminal and the second high-frequency connection terminal, the first mounting part is located on an inner side of the second external grounding member, and the second mounting part is located on the inner side of the second external grounding member.

In the present disclosure, the second external grounding member closed in a spherical shape shields the electromagnetic waves, and thus the first high-frequency connection terminal and the second high-frequency connection terminal transmitting the high frequency signals can transmit signals stably in a transmission band.

DETAILED DESCRIPTION

Hereinafter, an embodiment of an electrical connector set 1 and a circuit board 2 on which the electrical connector set 1 is mounted will be described with reference to the drawings. For convenience, each of the drawings shows an X-axis, a Y-axis, and a Z-axis that are orthogonal to each other.

[Electrical Connector Set]

Figure 1:
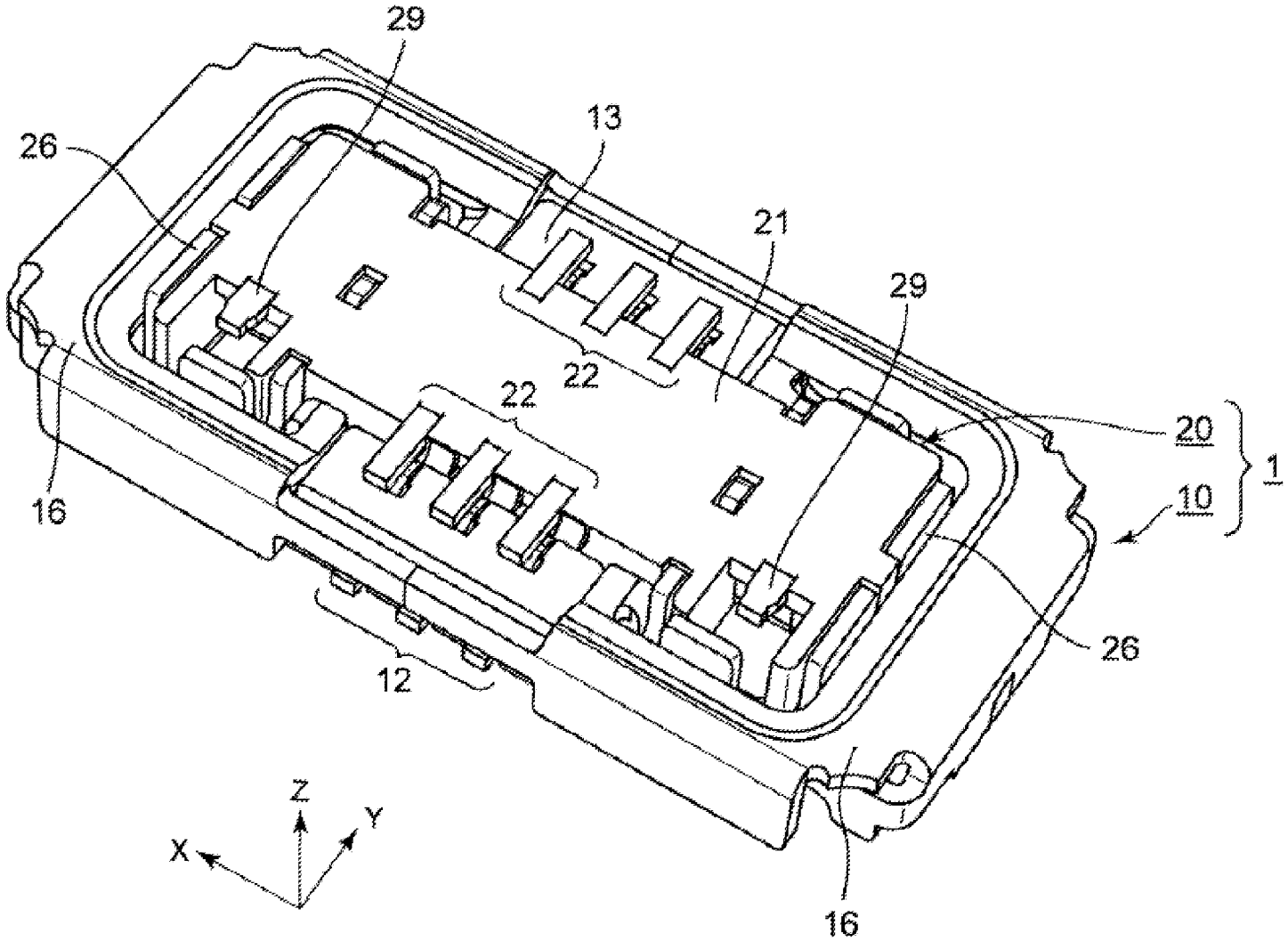
FIG. 1 is a perspective view of an electrical connector set according to one embodiment.
Figure 2:
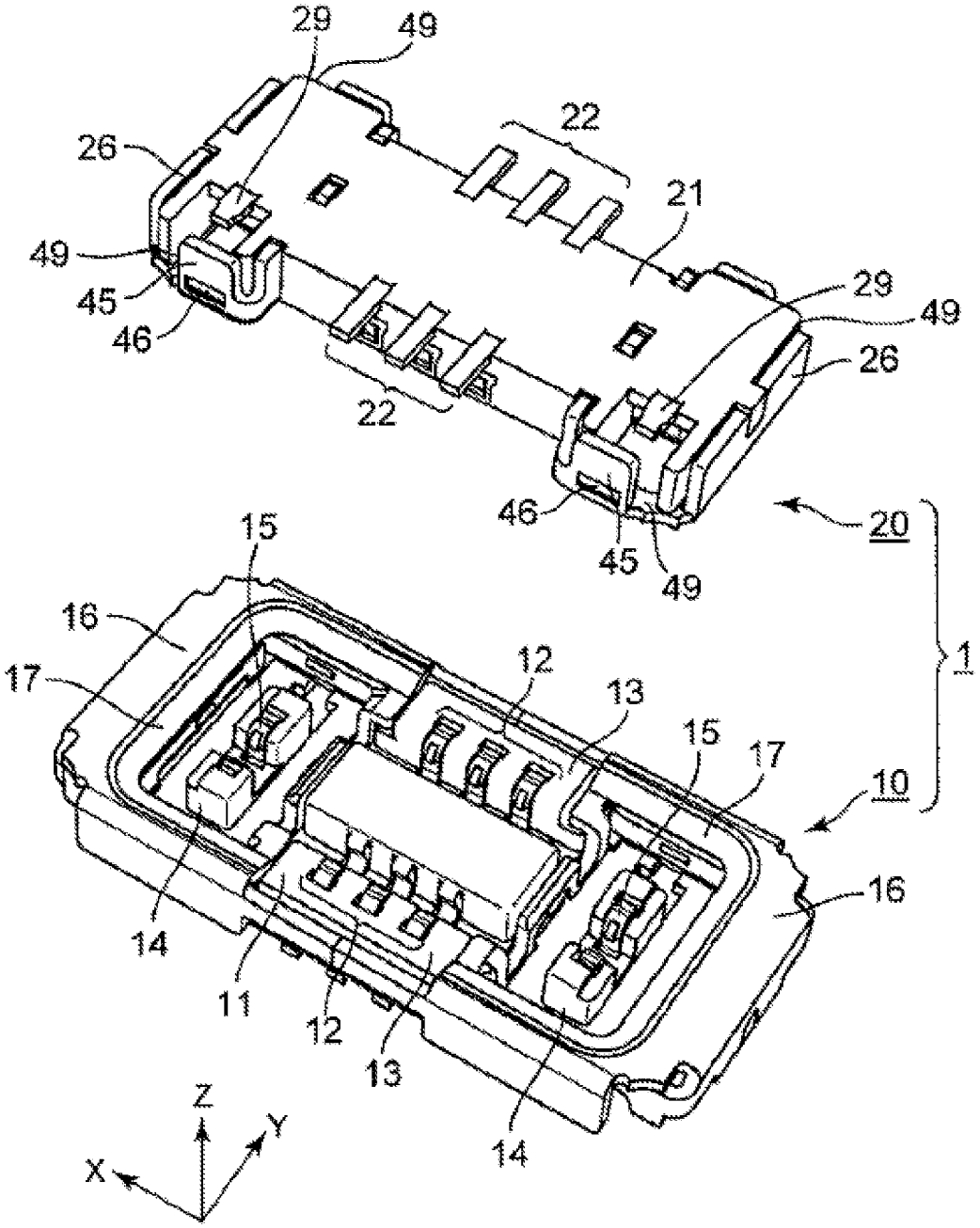
FIG. 2 is an exploded perspective view of the electrical connector set shown in FIG. 1.

FIG. 1 is a perspective view of the electrical connector set 1 according to one embodiment. FIG. 2 is an exploded perspective view of the electrical connector set 1 shown in FIG. 1.

As shown in FIGS. 1 and 2, the electrical connector set 1 includes a first connector 10 and a second connector 20 that is extractably fitted to the first connector 10 in an insertion-extraction direction (Z-axis direction). As shown in FIG. 2, the electrical connector set 1 is configured such that the second connector 20 is moved toward the first connector 10 in the insertion-extraction direction (Z-axis direction) with the second connector 20 facing the first connector 10 to fit the first connector 10 and the second connector 20 to each other.

[First Connector]

Figure 3:
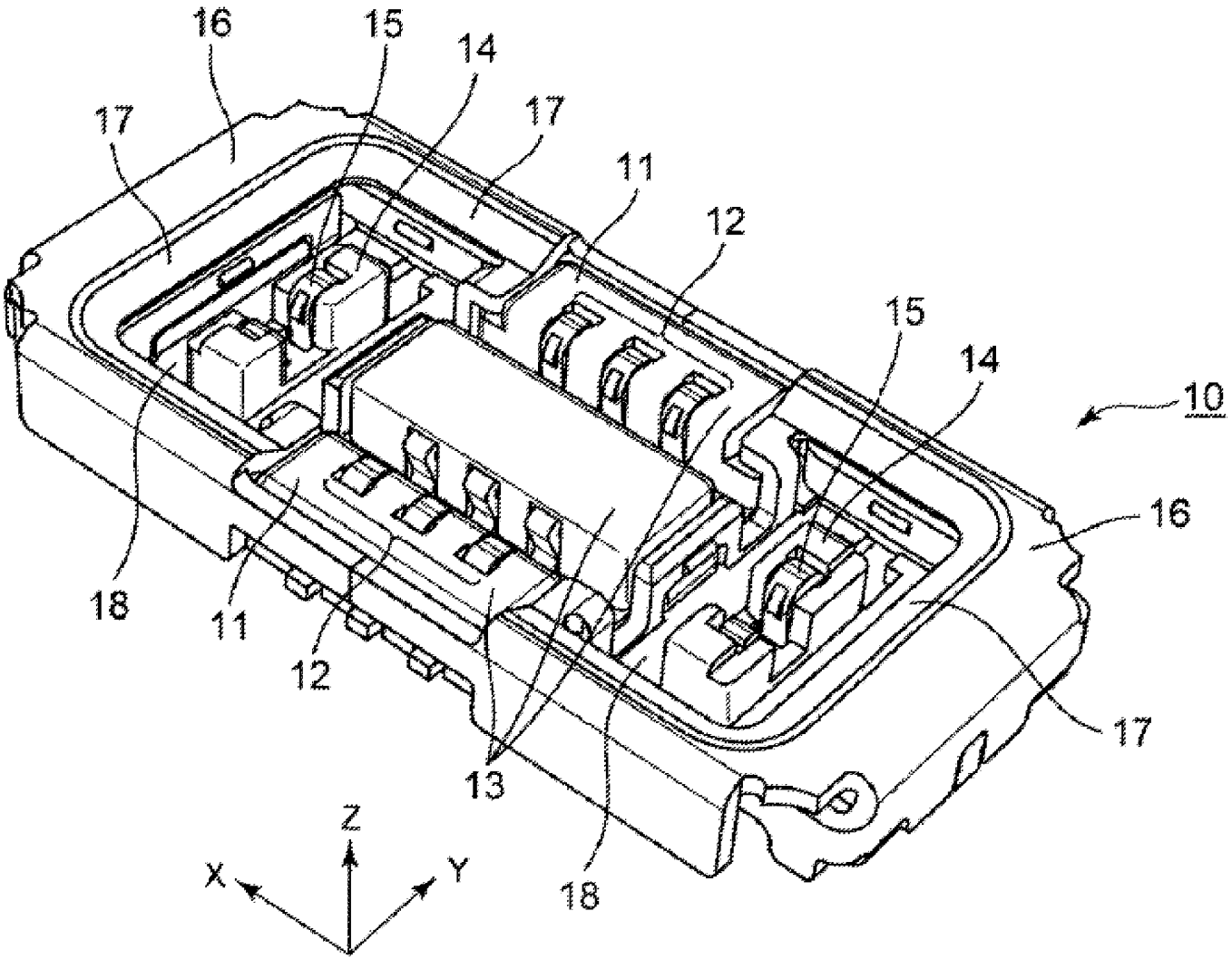
FIG. 3 is a perspective view of a first connector configuring the electrical connector set shown in FIG. 1.

FIG. 3 is a perspective view of the first connector 10 configuring the electrical connector set 1 shown in FIG. 1.

The first connector 10 has a first insulating member 11, a first connection terminal 12, two first high-frequency connection terminals 15 and 15 (which hereinafter may be simply referred to as a first high-frequency connection terminal 15), and two first external grounding members 16 and 16 (which hereinafter may be simply referred to as a first external grounding member 16). As the first insulating member 11, for example, an electrically insulating resin such as a liquid crystal polymer is used. The first insulating member 11 has a first central support 13 and two first side supports 14. The first central support 13 is disposed substantially at a center in a longitudinal direction (X-axis direction) of the first connector 10, and the two first side supports 14 are disposed at both ends of the first connector 10 in the longitudinal direction (X-axis direction).

The first central support 13 has a recessed first connection terminal mounting part. The first connection terminal 12 is mounted on the first connection terminal mounting part to support the first connection terminal 12. The first connection terminal 12 is disposed substantially at the center of the first connector 10 in the longitudinal direction (X-axis direction), and is configured by a plurality of connection terminals (having a recessed shape, for example) arranged along the longitudinal direction (X-axis direction). Thus, the first connection terminal 12 is generally also referred to as a female multi-pole connection terminal. In the first connection terminal 12 shown in FIG. 3, three connection terminals are each arranged in two rows along the longitudinal direction (X-axis direction). The arrangement of the multi-pole first connection terminals 12 is not limited to two rows, but may be one row or three or more rows. Further, the number of the first connection terminals 12 per row is not limited to three, and can be two or less or four or more.

In order to suppress interference of electromagnetic waves between the rows of the first connection terminals 12, a conductive shield member (not shown) may be provided between the rows of the first connection terminals 12. The shield member may be supported by being fitted into a central groove of the first central support 13, for example. Further, the shield member may extend in the longitudinal direction between the rows of the first connection terminals 12. Although the plurality of recessed connection terminals is arranged as the first connection terminals 12, a plurality of protruding connection terminals may be arranged. In this case, a plurality of recessed connection terminals is arranged in place of the plurality of protruding connection terminals on second connection terminals 22 engaging the first connection terminals 12.

The first connection terminal 12 is, for example, a conductor connected to a signal potential or a ground potential, and is configured by bending a rod-shaped member having conductivity. For example, phosphor bronze can be used as the first connection terminals 12. Phosphor bronze is a material that is both conductive and elastically deformable. A surface of the first connection terminals 12 may be plated with gold, for example.

Each of the first side supports 14 has a first high-frequency connection terminal mounting part and a first external grounding member mounting part. The corresponding first high-frequency connection terminal (having a recessed shape, for example) 15 is mounted and supported on the first high-frequency connection terminal mounting part. The corresponding first external grounding member 16 is mounted and supported on the first external grounding member mounting part.

The first high-frequency connection terminal 15 is a conductor that transmits a high frequency signal having a frequency higher than a signal transmitted by the first connection terminal 12. The first high-frequency connection terminal 15 is configured by bending a rod-shaped member having conductivity. The first high-frequency connection terminal 15 has a first mounting part 19 for mounting on the first circuit board 3, which will be described later. As the first high-frequency connection terminal 15, for example, phosphor bronze can be used. Phosphor bronze is a material that is both conductive and elastically deformable. A surface of the first high-frequency connection terminal 15 may be gold-plated, for example.

The first high-frequency connection terminal 15 is, for example, a connection terminal for millimeter wave signal transmission. Millimeter waves have wavelengths in a range of 1 mm to 10 mm and frequencies in a range of 30 GHz to 300 GHz. The first high-frequency connection terminal 15 can be, for example, a connection terminal for millimeter wave signal transmission in a range of 40 GHz to 100 GHz.

The first external grounding member 16 is a conductor connected to the ground potential. By connecting the first external grounding member 16 to the ground potential, the first external grounding member 16 can shield electromagnetic waves from outside of the first connector 10 and unnecessary radiation from the first high-frequency connection terminal 15, and make a space surrounded by the first external grounding member 16 an electromagnetic wave shielding space. That is, the first external grounding member 16 is a member for electromagnetically shielding the first high-frequency connection terminal 15. As the first external grounding member 16, for example, phosphor bronze can be used. Phosphor bronze is a material that is both conductive and elastically deformable. The first external grounding member 16 is formed by, for example, bending.

In the first connector 10 shown in FIG. 3, a plurality (two) of the first external grounding members 16 is arranged, and the first connection terminals 12 are provided between the two first external grounding members 16 and 16 spaced apart from each other. In this configuration, the electromagnetically shielding first external grounding members 16 can suppress interference of the signals between the first connection terminals 12 and one of the first high-frequency connection terminals 15, and between the first connection terminals 12 and the other first high-frequency connection terminals 15.

[Second Connector]

Figure 4:
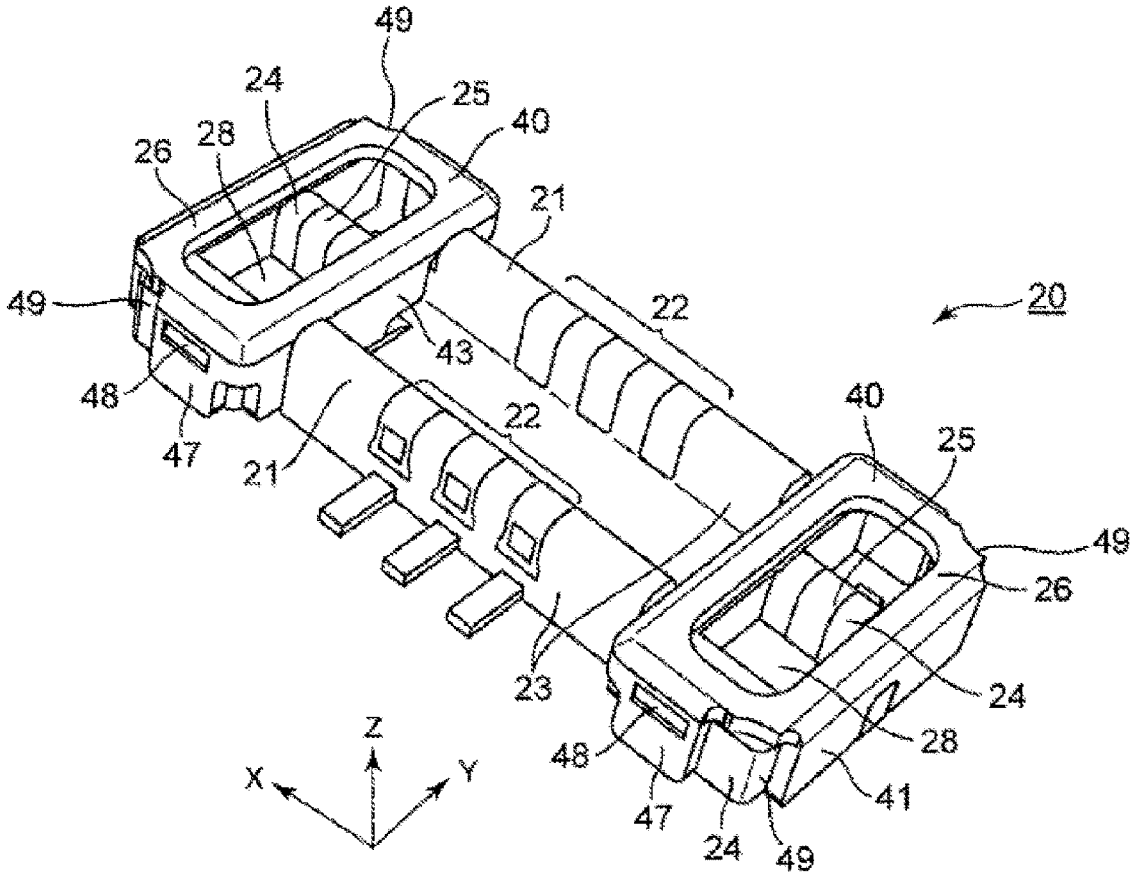
FIG. 4 is a perspective view of a second connector configuring the electrical connector set shown in FIG. 1.

FIG. 4 is a perspective view of the second connector 20 configuring the electrical connector set 1 shown in FIG. 1.

The second connector 20 has a second insulating member 21, a second connection terminal 22, two second high-frequency connection terminals 25 and 25 (which hereinafter may be simply referred to as a second high-frequency connection terminal 25), and two second external grounding members 26 and 26 (which hereinafter may be simply referred to as a second external grounding member 26). As the second insulating member 21, for example, an electrically insulating resin such as a liquid crystal polymer is used. The second insulating member 21 has a second central support 23 and two second side supports 24. The second central support 23 is disposed substantially at a center in the longitudinal direction (X-axis direction) of the second connector 20, and the two second side supports 24 are disposed at both ends of the second connector 20 in the longitudinal direction (X-axis direction).

The second central support 23 has a recessed second connection terminal mounting part. The second connection terminal 22 is mounted on the second connection terminal mounting part to support the second connection terminal 22. The second connection terminal 22 is disposed substantially at the center of the second connector 20 in the longitudinal direction (X-axis direction), and is configured by a plurality of connection terminals (having a protruding shape, for example) arranged along the longitudinal direction (X-axis direction). Thus, the second connection terminal 22 is generally also referred to as a male multi-pole connection terminal. The second connection terminal 22 has a one-to-one correspondence with the first connection terminal 12. The second connection terminal 22 engages the corresponding first connection terminal 12 to form an electrical connection.

In order to suppress interference of electromagnetic waves between the rows of the second connection terminals 22, a conductive shield member (not shown) may be provided between the rows of the second connection terminals 22. The shield member may be supported by being fitted into a central groove of the second central support 23, for example. Further, the shield member may extend in the longitudinal direction (X-axis direction) between the rows of the second connection terminals 22.

The second connection terminal 22 is, for example, a conductor connected to a signal potential or a ground potential, and is configured by bending a rod-shaped member having conductivity. For example, phosphor bronze can be used as the second connection terminals 22. Phosphor bronze is a material that is both conductive and elastically deformable. A surface of the second connection terminals 22 may be plated with gold, for example.

Each of the two second side supports 24 has a second high-frequency connection terminal mounting part and a second external grounding member mounting part. The corresponding second high-frequency connection terminal (having a protruding shape, for example) 25 is mounted and supported on the second high-frequency connection terminal mounting part. The corresponding second external grounding member 26 is mounted and supported on the second external grounding member mounting part.

The second high-frequency connection terminal 25 is a conductor that transmits a high frequency signal having a frequency higher than a signal transmitted by the second connection terminal 22. The second high-frequency connection terminal 25 is configured by bending a rod-shaped member having conductivity. The second high-frequency connection terminal 25 has a second mounting part 29 for mounting on a second circuit board 4, which will be described later. As the second high-frequency connection terminal 25, for example, phosphor bronze can be used. Phosphor bronze is a material that is both conductive and elastically deformable. A surface of the second high-frequency connection terminal 25 may be gold-plated, for example.

The second high-frequency connection terminal 25 is, for example, a connection terminal for millimeter wave signal transmission. Millimeter waves have wavelengths in a range of 1 mm to 10 mm and frequencies in a range of 30 GHz to 300 GHz. The second high-frequency connection terminal 25 can be, for example, a connection terminal for millimeter wave signal transmission in a range of 40 GHz to 100 GHz.

The second external grounding member 26 is a conductor connected to the ground potential. By connecting the second external grounding member 26 to the ground potential, the second external grounding member 26 can shield electromagnetic waves from outside of the second connector 20 and unnecessary radiation from the second high-frequency connection terminal 25, and make a space surrounded by the second external grounding member 26 an electromagnetic wave shielding space. That is, the second external grounding member 26 is a member for electromagnetically shielding the second high-frequency connection terminal 25. As the second external grounding member 26, for example, phosphor bronze can be used. Phosphor bronze is a material that is both conductive and elastically deformable. The second external grounding member 26 is formed by, for example, bending.

[First External Grounding Member]

Figure 5:
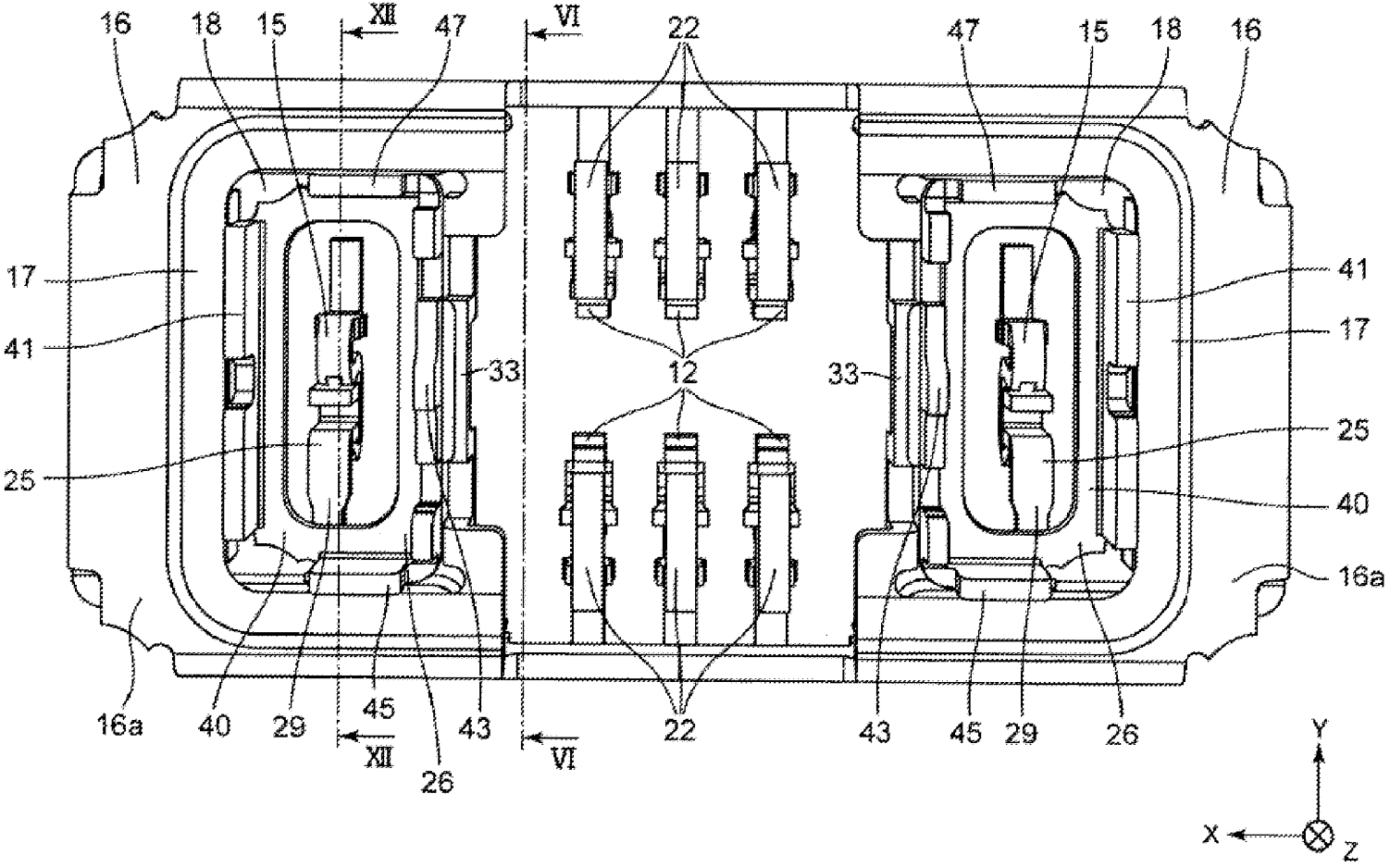
FIG. 5 is a plan view of the electrical connector set shown in FIG. 1 from which a first insulating member and a second insulating member are removed.
Figure 6:
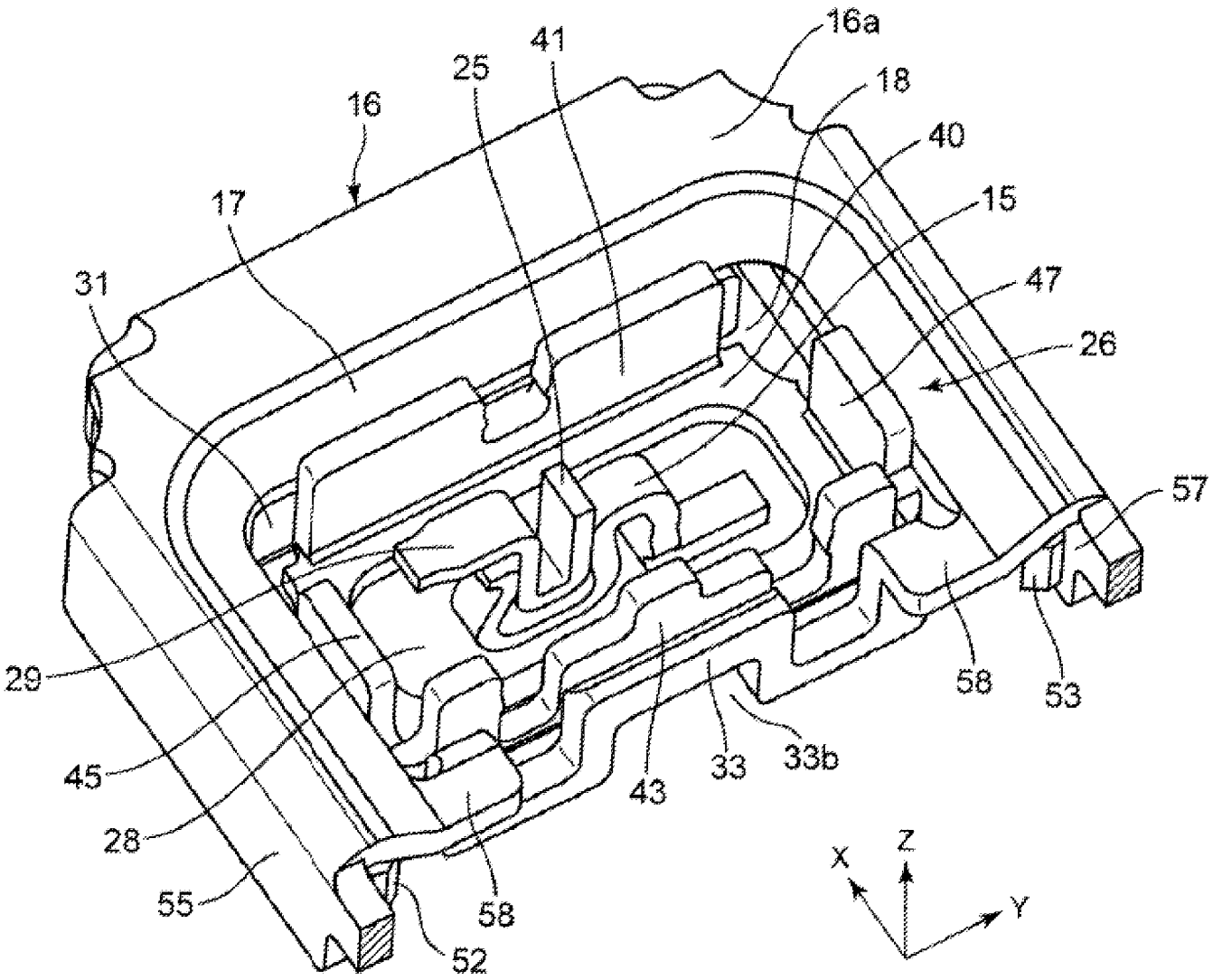
FIG. 6 is a perspective view showing a cross-sectional structure along line VI-VI in FIG. 5.
Figure 7:
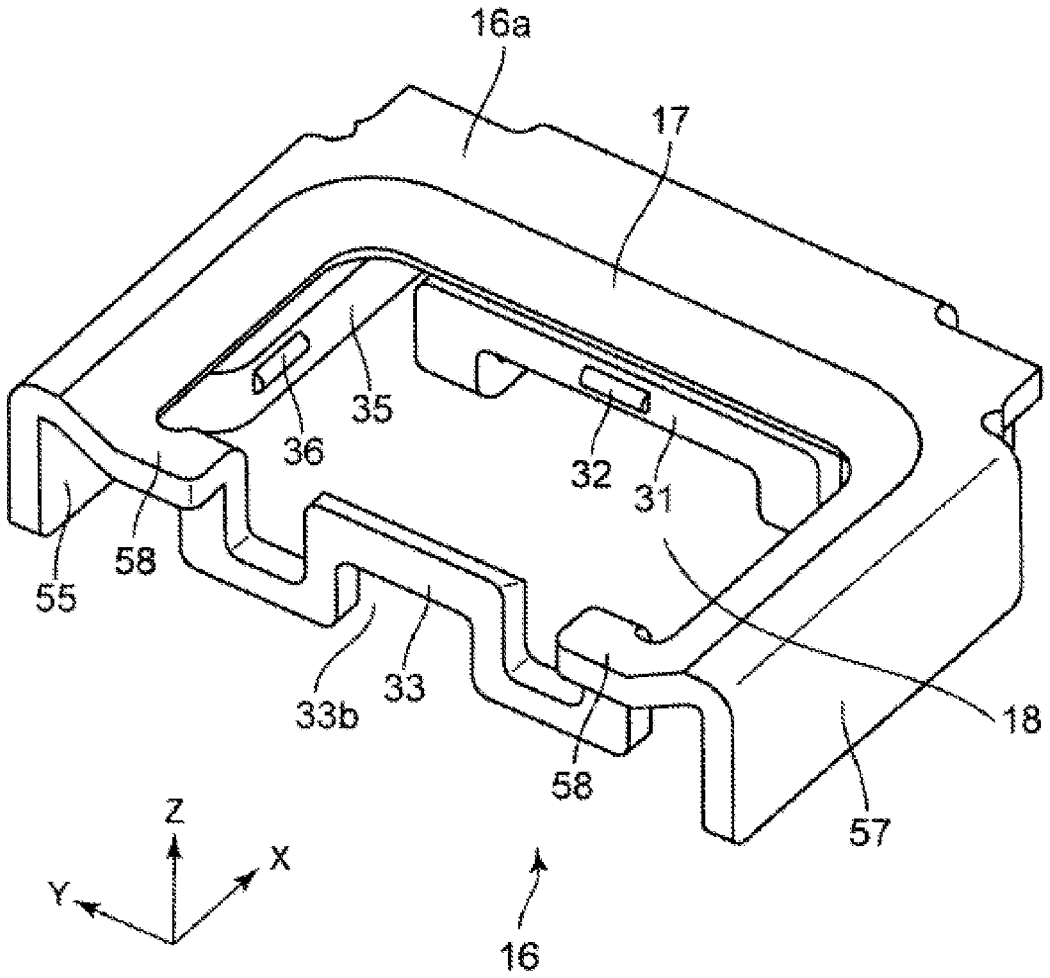
FIG. 7 is a perspective view of a first external grounding member of the first connector as viewed from above.
Figure 8:
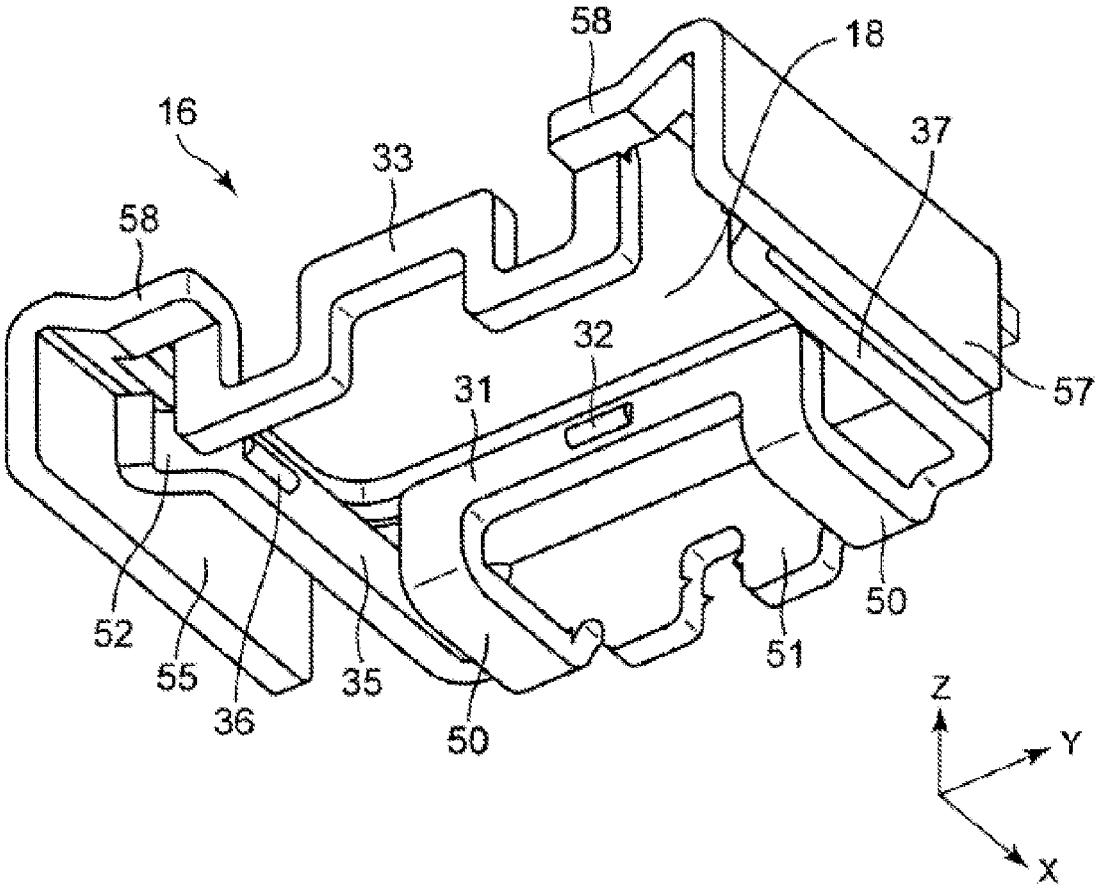
FIG. 8 is a perspective view of the first external grounding member in FIG. 7 as viewed from below.
Figure 9:
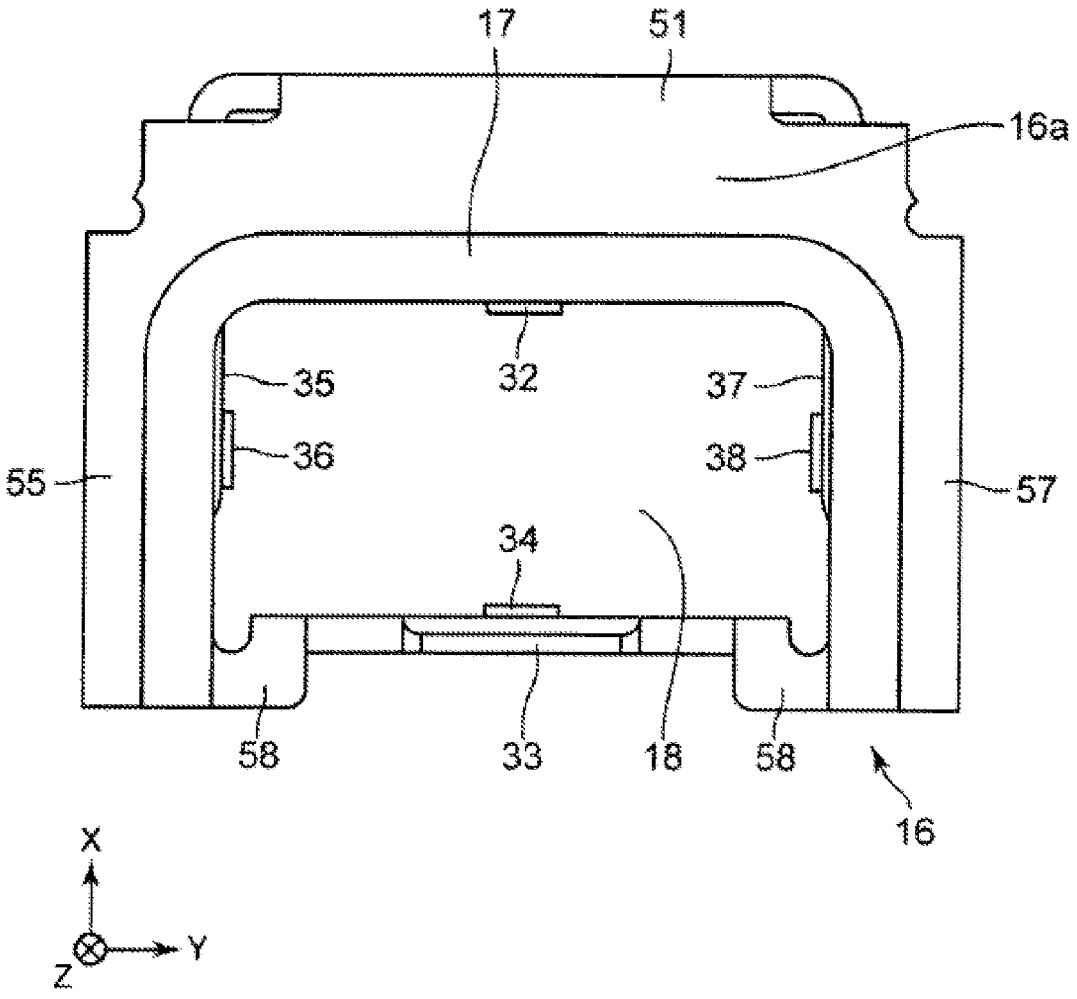
FIG. 9 is a top view of the first external grounding member in FIG. 7.
Figure 10:
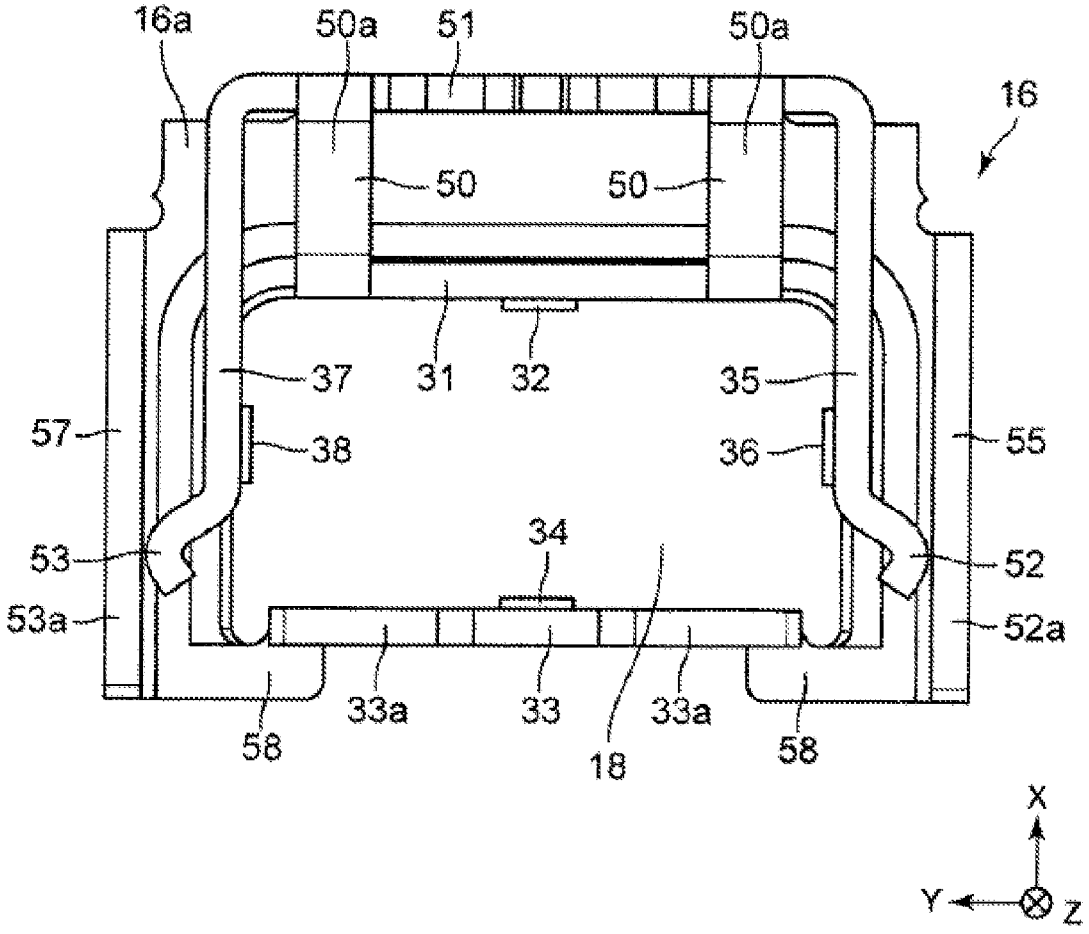
FIG. 10 is a bottom view of the first external grounding member in FIG. 7.

FIG. 5 is a plan view of the electrical connector set shown in FIG. 1 from which the first insulating member 11 and the second insulating member 21 are removed. FIG. 6 is a perspective view showing a cross-sectional structure along line VI-VI in FIG. 5. FIG. 7 is a perspective view of the first external grounding member 16 of the first connector 10 as viewed from above. FIG. 8 is a perspective view of the first external grounding member 16 in FIG. 7 as viewed from below. FIG. 9 is a top view of the first external grounding member 16 in FIG. 7. FIG. 10 is a bottom view of the first external grounding member 16 in FIG. 7.

As shown in FIGS. 5 to 10, each first external grounding member 16 has a substantially rectangular shape in a plan view from the insertion-extraction direction (Z-axis direction), and is closed in a peripheral shape in a plan view so as to continuously surround the first high-frequency connection terminal 15 and the second high-frequency connection terminal 25. Here, the peripheral shape is not limited to a polygonal peripheral shape, and may be, for example, a circumferential shape, an elliptical circumferential shape, or a shape combining a polygonal peripheral shape and a circumferential shape. Each first external grounding member 16 has a first base 16*a*, a guide 17, and a mounting cavity 18. The first base 16*a* has a substantially U-shape in a plan view. The guide 17 has a substantially U-shape in a plan view, and is inclined downward from an outer side to an inner side. The guide 17 is used as a guide for accurately guiding the second external grounding member 26 to the mounting cavity 18 when the second connector 20 is inserted into the first connector 10 in the insertion-extraction direction (Z-axis direction). The mounting cavity 18 is an opening formed on the inner side of the guide 17, and has a substantially rectangular shape in a plan view.

As shown in FIGS. 7 and 8, an outer wall 51 is erected in the insertion-extraction direction (Z-axis direction) on the outer side of the first base 16*a* (in an X-axis positive direction). The outer wall 51 extends in the Y-axis direction. On a first side (in a Y-axis negative direction) of the first base 16*a*, a first-side wall 55 is erected in the insertion-extraction direction (Z-axis direction). The first-side wall 55 extends in the X-axis direction. On a second side (in a Y-axis positive direction) of the first base 16*a*, a second-side wall 57 is erected in the insertion-extraction direction (Z-axis direction). The second-side wall 57 extends in the X-axis direction.

Two arms 50 and 50 (which hereinafter may be simply referred to as arms 50) are formed at a lower part of the outer wall 51. The arms 50 extend toward the inner side (X-axis direction) and are connected to an outer elastic part 31. The outer elastic part 31 is erected in the Z-axis direction and extends in the Y-axis direction. The outer elastic part 31 is elastically supported with respect to the outer wall 51 with the arms 50 interposed therebetween.

A first-side elastic part 35 is formed at a side on the first side of the outer wall 51. The first-side elastic part 35 extends toward the inner side (X-axis direction). A first-side end 52 is formed at an inner end of the first-side elastic part 35. The first-side end 52 protrudes toward an inner surface of the first-side wall 55 and is curved so as to slidably contact the inner surface of the first-side wall 55.

A second-side elastic part 37 is formed at a side on the second side of the outer wall 51. The second-side elastic part 37 extends toward the inner side (X-axis direction). The second-side end 53 is formed at an inner end of the second-side elastic part 37. The second-side end 53 protrudes toward an inner surface of the second-side wall 57 and is curved so as to slidably contact the inner surface of the second-side wall 57.

An inner connection 58 is formed at each of the inner end on the first side and the inner end on the second side of the guide 17. Each of the inner connections 58 extends in the Y-axis direction and is connected to an inner elastic part 33. The inner elastic part 33 is erected in the Z-axis direction and extends in the Y-axis direction. The inner elastic part 33 has a shape that is bent a plurality of times by combining a U-shape, an inverted U-shape, and a U-shape. The inner elastic part 33 is elastically supported with respect to the guide 17 with the two inner connections 58 and 58 interposed therebetween.

An inner peripheral part of the first external grounding member 16 has a plurality of side parts, for example, four side parts. The outer elastic part 31, the inner elastic part 33, the first-side elastic part 35, and the second-side elastic part 37 serve as the side parts. A contact part 32 protruding toward the inner side is formed on an inner surface of the outer elastic part 31. A contact part 34 protruding toward the outer side is formed on an inner surface of the inner elastic part 33. A contact part 36 protruding toward the second side is formed on an inner surface of the first-side elastic part 35. A contact part 38 protruding toward the first side is formed on an inner surface of the second-side elastic part 37.

In the first external grounding member 16 shown in FIGS. 5 to 10, the contact parts are disposed apart from each other in a peripheral direction at four locations of the contact parts 32, 34, 36, and 38 in a plan view. Each of the contact parts 32, 34, 36, and 38 contacts the second external grounding member 26 and is used for electrical connection with the second external grounding member 26, as will be described later.

The contact part 34 is formed between the first external grounding member 16 and the second external grounding member 26, and the contact part 34 is disposed on a side facing at least the first connection terminal 12 and the second connection terminal 22. In other words, the contact part 34 is disposed in a region formed between at least one of the first high-frequency connection terminal 15 or the second high-frequency connection terminal 25 and at least one of the first connection terminal 12 or the second connection terminal 22. As a result, an electrical connection is established by the contact part 34 on the side facing the first connection terminal 12 and the second connection terminal 22, and the first high-frequency connection terminal 15 and the second high-frequency connection terminal 25 are electromagnetically shielded.

The contact parts can be disposed apart from each other in the peripheral direction at at least three locations as viewed in a plan view from the insertion-extraction direction (Z-axis direction). The first external grounding member 16 can include, for example, the contact part 34, the contact part 36, and the contact part 38, or include the contact part 32, the contact part 34, and the contact part 36, or include the contact part 32, the contact part 34, and the contact part 38. As a result, the electrical connection between the first external grounding member 16 and the second external grounding member 26 can be stabilized.

A peripheral distance between the adjacent contact part 32, contact part 34, the contact part 36, and the contact part 38 is, for example, less than or equal to half of the wavelength of the millimeter wave signal. For example, the peripheral distance between the adjacent contact part 32 and the contact part 36, between the adjacent contact part 36 and the contact part 34, between the adjacent contact part 34 and the contact part 38, and between the adjacent contact part 38 and the contact part 32 is less than or equal to half of the wavelength of the millimeter wave signal. It is therefore possible to suppress leakage of unnecessary radiation in a millimeter wave band through the peripheral distance between the adjacent contact parts.

[Second External Grounding Member]

As shown in FIGS. 5 and 6, each second external grounding member 26 has a substantially rectangular shape in a plan view from the insertion-extraction direction (Z-axis direction), and is closed in a peripheral shape in a plan view so as to continuously surround the first high-frequency connection terminal 15 and the second high-frequency connection terminal 25. Here, the peripheral shape is not limited to a polygonal peripheral shape, and may be, for example, a circumferential shape, an elliptical circumferential shape, or a shape combining a polygonal peripheral shape and a circumferential shape. The second external grounding member 26 has a second grounding base 40, an outer wall 41, an inner wall 43, a first-side wall 45, a second-side wall 47, and an insertion cavity 28.

The insertion cavity 28 having a substantially rectangular shape in a plan view is formed at a center of the second grounding base 40. Thus, the second grounding base 40 has a substantially rectangular annular shape in a plan view. The first high-frequency connection terminal 15 and the second high-frequency connection terminal 25 are surrounded by the second grounding base 40 and are located in the insertion cavity 28 in a plan view.

The outer wall 41 is erected on the outer side of the second grounding base 40 in a plane in the insertion-extraction direction (Z-axis direction). The inner wall 43 is erected on the inner side of the second grounding base 40 in a plane in the insertion-extraction direction (Z-axis direction). The first-side wall 45 is erected on the first side of the second grounding base 40 in a plane in the insertion-extraction direction (Z-axis direction). The second-side wall 47 is erected on the second side of the second grounding base 40 in a plane in the insertion-extraction direction (Z-axis direction).

In the second external grounding member 26, a cutout part 49 is provided between the outer wall 41 and the first-side wall 45 and between the outer wall 41 and the second-side wall 47 in a plan view from the insertion-extraction direction (Z-axis direction). This makes it possible to adjust a fitting strength. Further, a gap at the cutout part 49 is surrounded by the first external grounding member 16 at a time of fitting. In other words, the cutout part 49 of the second external grounding member 26 is surrounded by the first external grounding member 16 in a plan view from the insertion-extraction direction (Z-axis direction). As a result, unnecessary radiation from the first high-frequency connection terminal 15 and a second high-frequency connection terminal 25 can be suppressed while adjusting the fitting strength.

As shown in FIG. 2, a first-side connection recess 46 is formed on an outer surface of the first-side wall 45. As shown in FIG. 4, a second-side connection recess 48 is formed on an outer surface of the second-side wall 47. When the first connector 10 and the second connector 20 are fitted to each other, the first-side connection recess 46 is configured to engage the contact part 36 on the first side and the second-side connection recess 48 is configured to engage the contact part 38 on the second side.

[Engagement Structure and Fitting Structure in Electrical Connector Set]

Figure 11:
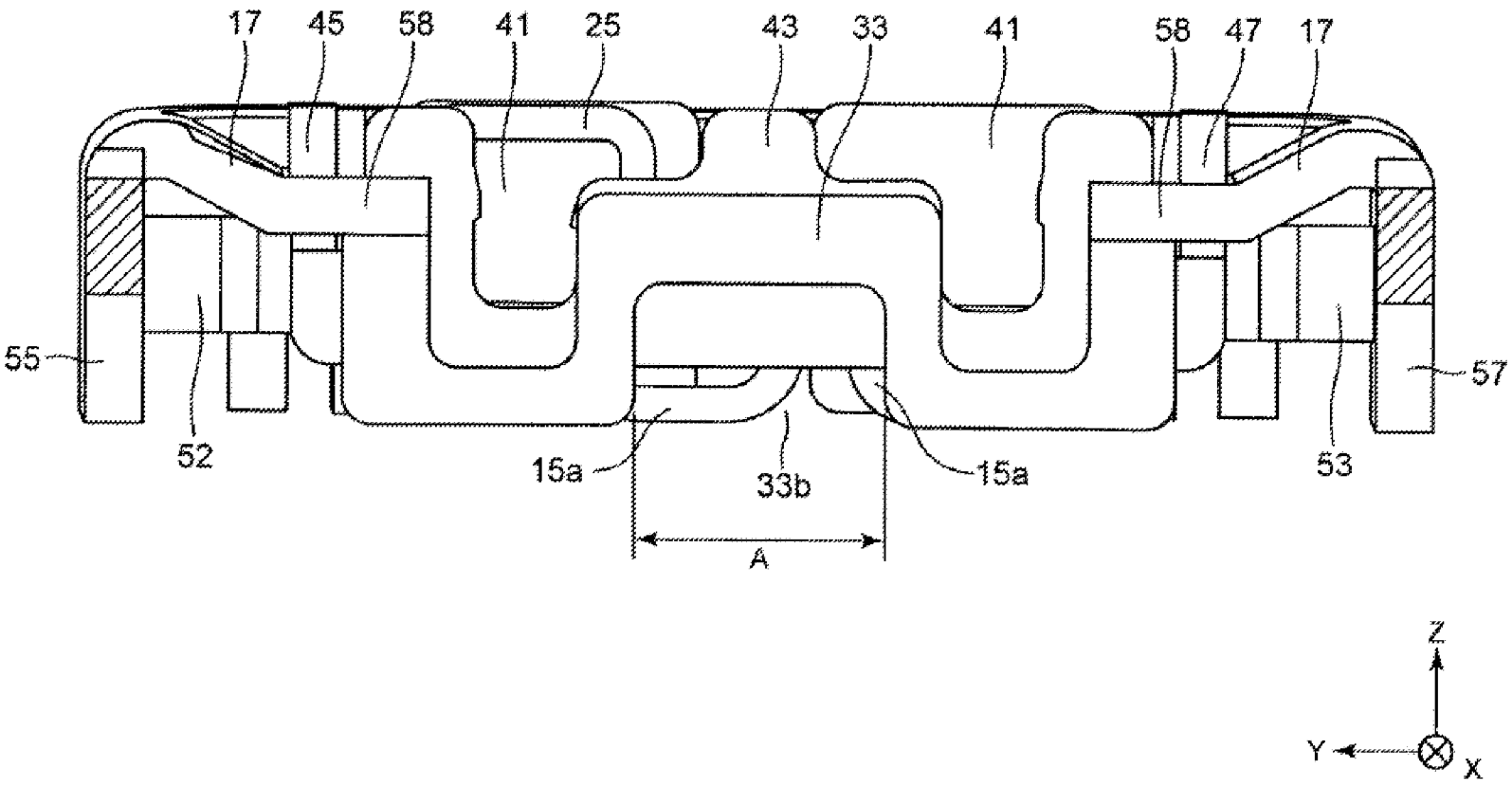
FIG. 11 is a diagram of the cross-sectional structure in FIG. 6 as viewed from a direction X.
Figure 12:
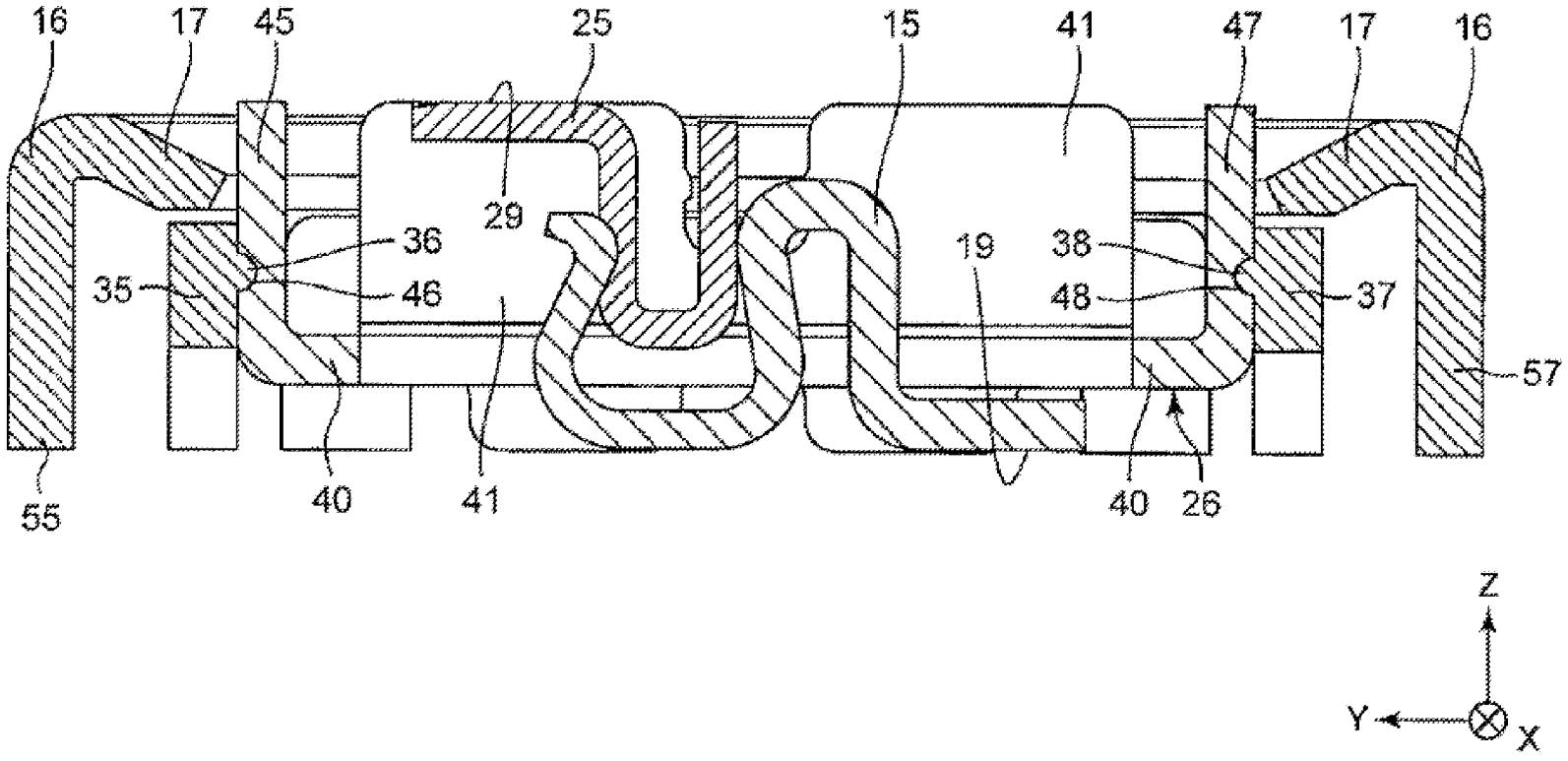
FIG. 12 is a diagram of a cross-sectional structure along line XII-XII in FIG. 5 as viewed from the direction X.

FIG. 11 is a diagram of the cross-sectional structure in FIG. 6 as viewed from a direction X. FIG. 12 is a diagram of the cross-sectional structure along line XII-XII in FIG. 5 as viewed from the direction X.

In the electrical connector set 1, the second connector 20 is fitted to the first connector 10 by pushing the second connector 20 in the insertion-extraction direction (Z-axis direction) with the second connector 20 facing the first connector 10. Specifically, as shown in FIG. 12, the second external grounding member 26 of the second connector 20 is fitted to the first external grounding member 16 of the first connector 10. More specifically, the second external grounding member 26 is guided by the guide 17 so as to be mounted on the mounting cavity 18, and then fitted to the first external grounding member 16. On the first side, the protruding contact part 36 engages the first-side connection recess 46, and on the second side, the protruding contact part 38 engages the second-side connection recess 48. As a result, the first connector 10 and the second connector 20 can be kept fitted to each other.

In this fitted state, the second connection terminal 22 engages the first connection terminal 12, and the second high-frequency connection terminal 25 engages the first high-frequency connection terminal 15. As a result, the first connection terminal 12 and the second connection terminal 22 are electrically connected, and the first high-frequency connection terminal 15 and the second high-frequency connection terminal 25 are electrically connected.

In the fitted state, the outer elastic part 31 faces the outer wall 41, the inner elastic part 33 faces the inner wall 43, the first-side elastic part 35 faces the first-side wall 45, and the second-side elastic part 37 faces the second-side wall 47. At this time, the contact part 32 on the outer side contacts the outer wall 41, the contact part 34 on the inner side contacts the inner wall 43, the contact part 36 on the first side contacts the first-side connection recess 46, and the contact part 38 on the second side contacts the second-side connection recess 48. As a result, the first external grounding member 16 and the second external grounding member 26 are electrically connected at the four locations, which are the contact part 32, the contact part 34, the contact part 36, and the contact part 38. These four contact parts 32, 34, 36, and 38 surround all sides of the first high-frequency connection terminal 15 as viewed from the insertion-extraction direction (Z-axis direction), and also surround all sides of the second high-frequency connection terminal 25 as viewed from the insertion-extraction direction (Z-axis direction) at the time of fitting.

As shown in FIGS. 6 and 12, the first high-frequency connection terminal 15 and the second high-frequency connection terminal 25 are on the inner side of the second external grounding member 26 closed in a peripheral shape, and the second external grounding member 26 is on the inner side of the first external grounding member 16 closed in a peripheral shape. That is, the first high-frequency connection terminal 15 and the second high-frequency connection terminal 25 are continuously surrounded by the second external grounding member 26, and the second external grounding member 26 is continuously surrounded by the first external grounding member 16. As a result, the first external grounding member 16 and the second external grounding member 26 shield the electromagnetic waves more effectively, and thus the first high-frequency connection terminal 15 and the second high-frequency connection terminal 25 transmitting the high frequency signals can transmit signals stably in a transmission band.

[Signal Transmission in Millimeter Wave Band]

When the first high-frequency connection terminal 15 and the second high-frequency connection terminal 25 are used as connection terminals for millimeter wave signal transmission, there are the following problems.

As described above, the millimeter wave band has a wavelength in the range of 1 mm to 10 mm and a frequency in the range of 30 GHz to 300 GHz. On the other hand, in order to achieve miniaturization and weight reduction, sizes of the components configuring the first connector 10 and the second connector 20 are significantly small. For example, the sizes of the first external grounding member 16 and the second external grounding member 26 are on the order of mm or sub mm.

As shown in FIG. 11, when the cross-sectional structure in the fitting state is viewed in a side view from a side surface direction (X-axis direction) that is orthogonal to the insertion-extraction direction (Z-axis direction) and in which the first connection terminal 12 and the second connection terminal 22 are located, the first high-frequency connection terminal 15 has a non-overlapping part 15*a* that does not overlap with the second external grounding member 26. A lateral cutout part 33*b* that does not overlap the non-overlapping part 15*a* is formed in the first external grounding member 16. That is, the inner elastic part 33, which is bent a plurality of times, has the lateral cutout part 33*b*, and a part of the first high-frequency connection terminal 15 is configured as the non-overlapping part 15*a* not to overlap with the lateral cutout part 33*b* in a side view. Here, the side view from the side surface direction that is orthogonal to the insertion-extraction direction and in which the first connection terminal 12 and the second connection terminal 22 are located refers to, for example, a view in which the first external grounding member 16, the second external grounding member 26, and the first high-frequency connection terminal 15 are viewed through and projected on the same plane.

When the size of the lateral cutout part 33*b* is larger than half of the wavelength of the transmitted millimeter wave signal, unnecessary radiation may leak through the lateral cutout part 33*b* and affect the first connection terminal 12 and the second connection terminal 22. Thus, a cutout length A in a third direction (Y-axis direction) orthogonal to the insertion-extraction direction (Z-axis direction) and the side surface direction (X-axis direction) at the lateral cutout part 33*b* is configured to be less than or equal to half of the wavelength of the transmitted millimeter wave signal. It is therefore possible to suppress leakage of unnecessary radiation in the millimeter wave band through the lateral cutout part 33*b*.

[Mounting of Electrical Connector Set on Circuit Board]

Figure 13:
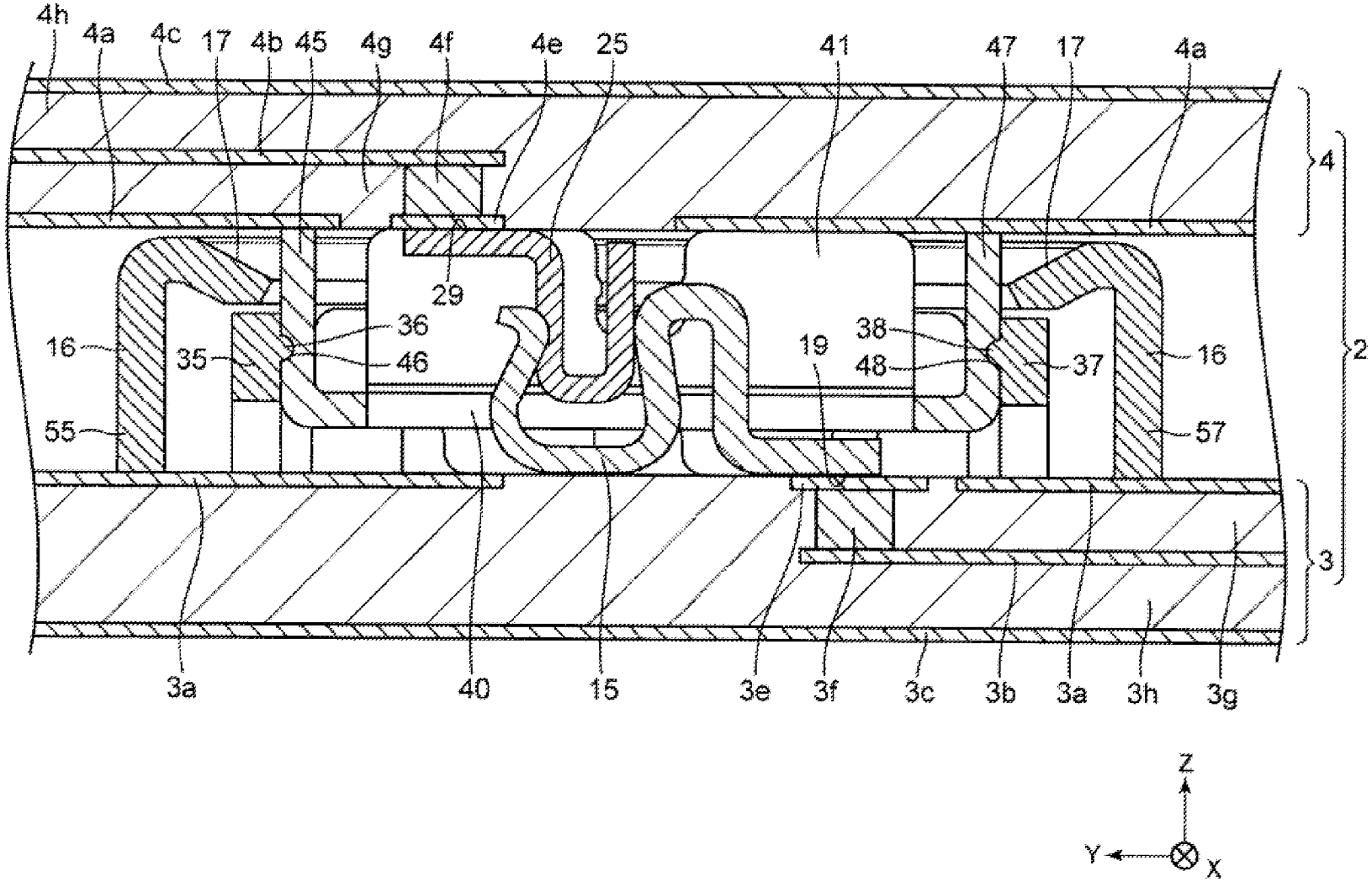
FIG. 13 is a diagram illustrating a cross-sectional structure when the electrical connector set in FIG. 1 is mounted on a circuit board

FIG. 13 is a diagram illustrating a cross-sectional structure when the electrical connector set 1 in FIG. 1 is mounted on the circuit board 2.

The circuit board 2 is configured by the first circuit board 3 and the second circuit board 4. The first connector 10 is mounted on the first circuit board 3, and the second connector 20 is mounted on the second circuit board 4.

In the first circuit board 3, a first inner grounding layer 3*a*, a first insulating layer 3*g*, a first conductive layer 3*b*, a second insulating layer 3*h*, and a first outer grounding layer 3*c* are stacked sequentially from a side facing the first connector 10. A first connecting part 3*e* is formed on a side of the first inner grounding layer 3*a*, and the first connecting part 3*e* is connected to the first conductive layer 3*b* with a first via 3*f* interposed therebetween. The first insulating layer 3*g* and the second insulating layer 3*h* may be the same.

The first connecting part 3*e* is used for mounting the first mounting part 19 of the first high-frequency connection terminal 15, and the first connecting part 3*e* and the first mounting part 19 are located on the inner side of the second external grounding member 26. The first mounting part 19 is electrically connected to the first connecting part 3*e* by a conductive member such as a solder bump. The first mounting part 19 is electromagnetically shielded by the second external grounding member 26 and the first connecting part 3*e* is electromagnetically shielded by the first inner grounding layer 3*a*, thereby suppressing unnecessary radiation from the first mounting part 19.

In the second circuit board 4, a second inner grounding layer 4*a*, a third insulating layer 4*g*, a second conductive layer 4*b*, a fourth insulating layer 4*h*, and a second outer grounding layer 4*c* are stacked sequentially from a side facing the second connector 20. A second connecting part 4*e* is formed on a side of the second inner grounding layer 4*a*, and the second connecting part 4*e* is connected to the second conductive layer 4*b* with a second via 4*f* interposed therebetween. The third insulating layer 4*g* and the fourth insulating layer 4*h* may be the same.

The second connecting part 4*e* is used for mounting the second mounting part 29 of the second high-frequency connection terminal 25, and the second connecting part 4*e* and the second mounting part 29 are located on the inner side of the second external grounding member 26. The second mounting part 29 is electrically connected to the second connecting part 4*e* by a conductive member such as a solder bump. The second mounting part 29 is electromagnetically shielded by the second external grounding member 26 and the second connecting part 4*e* is electromagnetically shielded by the second inner grounding layer 4*a*, thereby suppressing unnecessary radiation from the second mounting part 29.

Therefore, in the circuit board 2 on which the electrical connector set 1 is mounted, the first high-frequency connection terminal 15 and the second high-frequency connection terminal 25 for transmitting high frequency signals can transmit signals stably in the transmission band.

[Mounting/Supporting Structure of First External Grounding Member]

Figure 14:
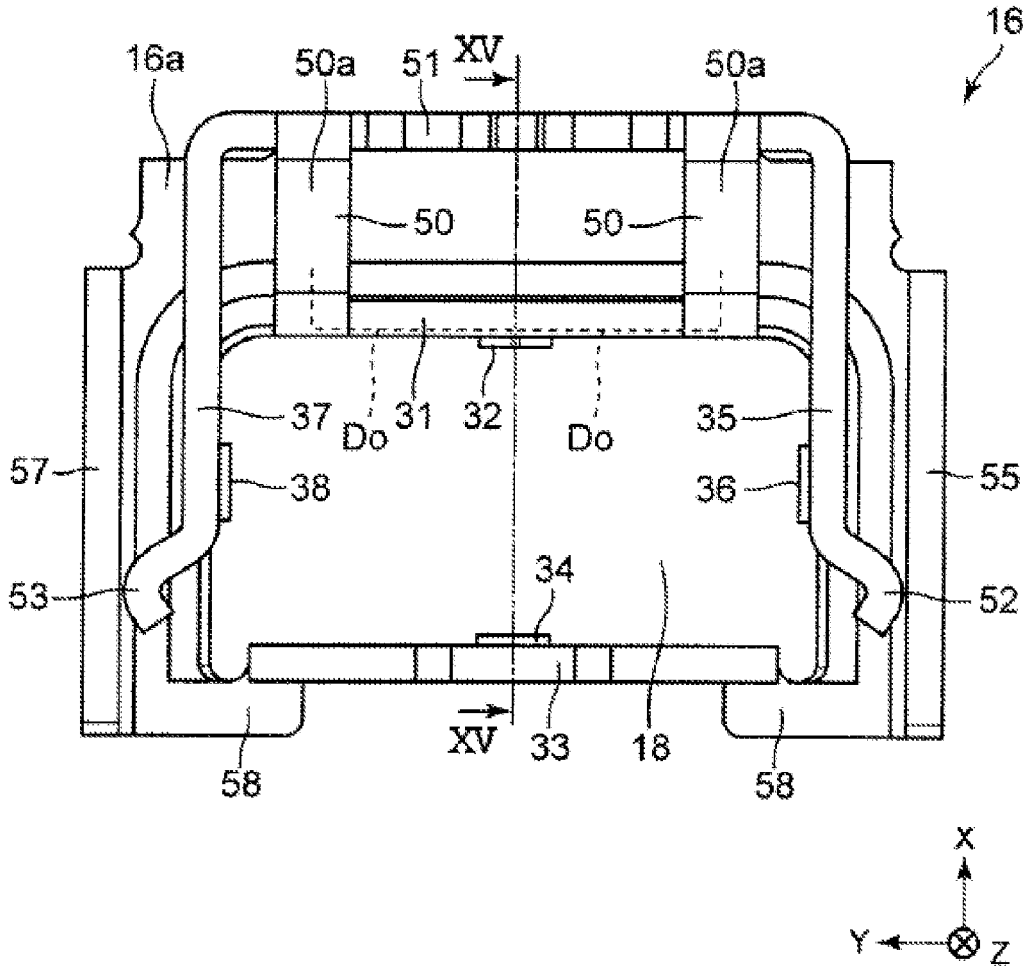
FIG. 14 is a bottom view illustrating a relationship between an outer mounting part and a contact part formed on an outer elastic part in the first external grounding member.
Figure 15:
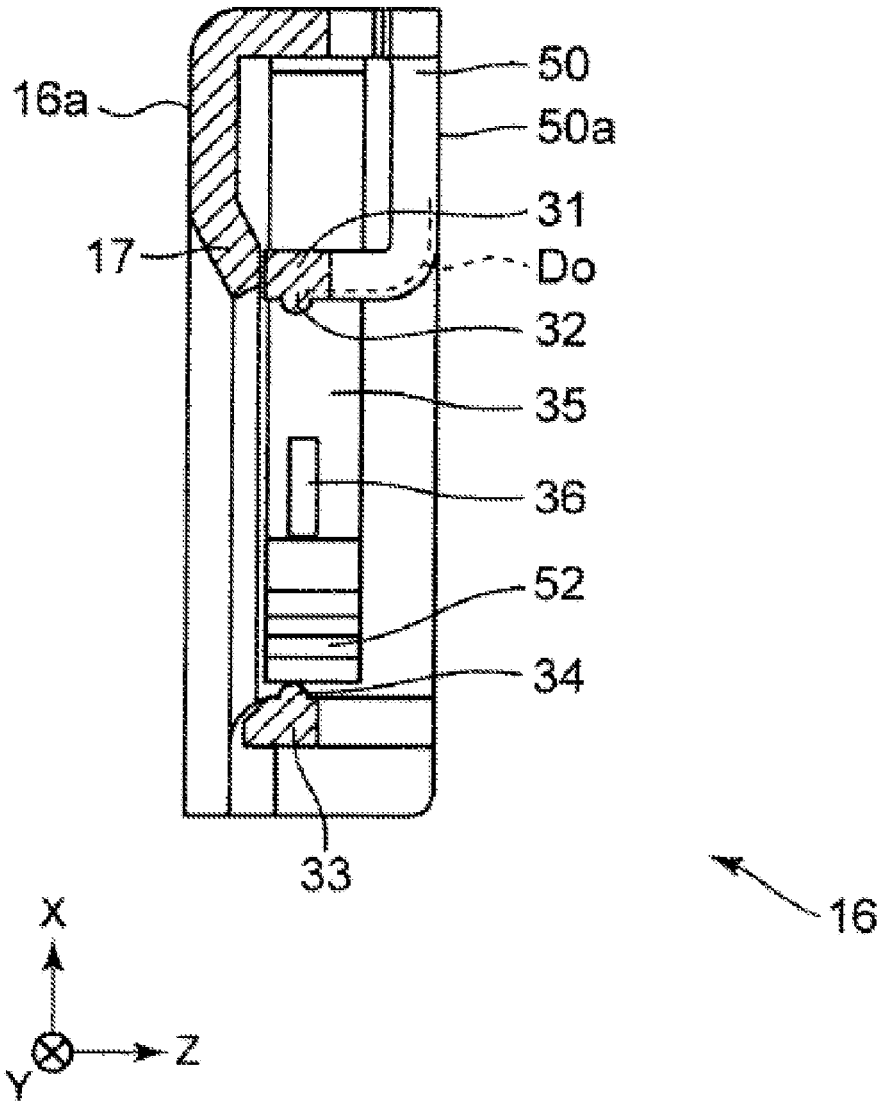
FIG. 15 is a diagram of a cross-sectional structure along line XV-XV in FIG. 14 as viewed from a direction Y.

FIG. 14 is a bottom view illustrating the relationship between outer mounting parts 50*a* and the contact part 32 formed on the outer elastic part 31 in the first external grounding member 16. FIG. 15 is a diagram of a cross-sectional structure along line XV-XV in FIG. 14 as viewed from a direction Y.

Figure 16:
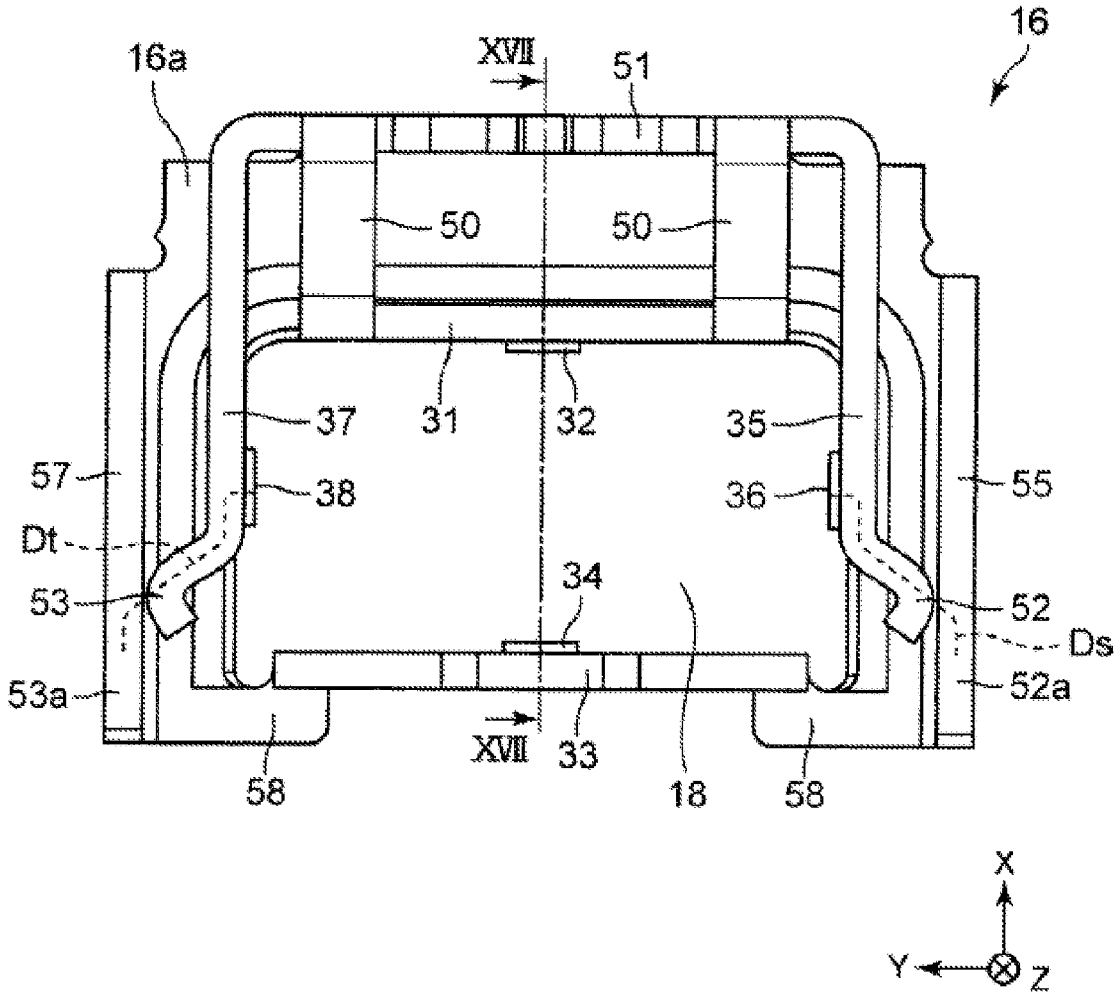
FIG. 16 is a bottom view illustrating a relationship between a first-side mounting part and a contact part formed in a first-side elastic part in the first external grounding member.
Figure 17:
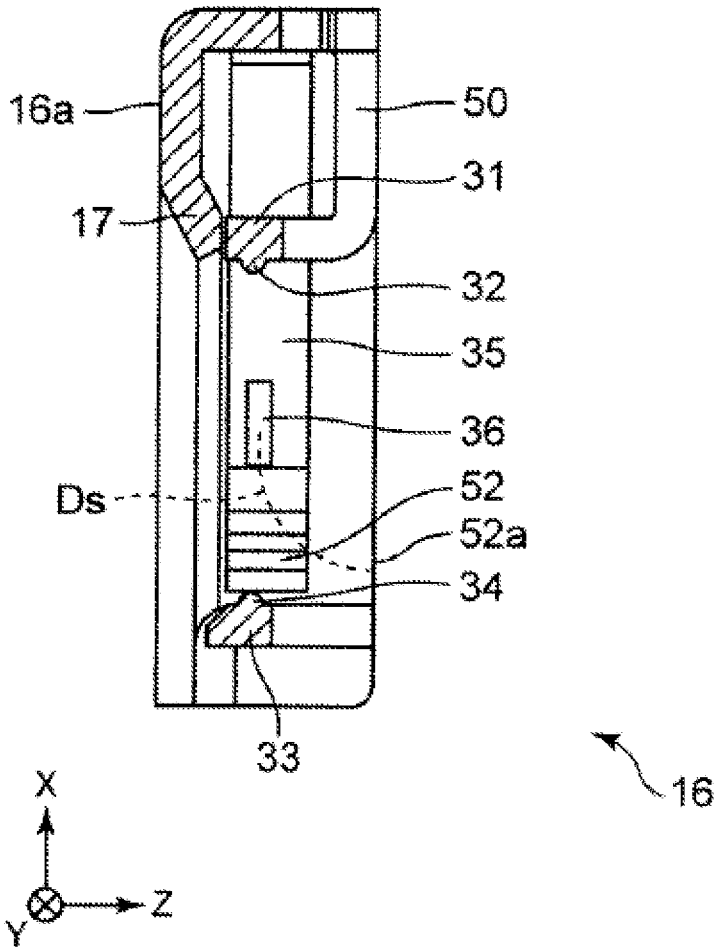
FIG. 17 is a diagram of a cross-sectional structure along line XVII-XVII in FIG. 16 as viewed from the direction Y.
Figure 18:
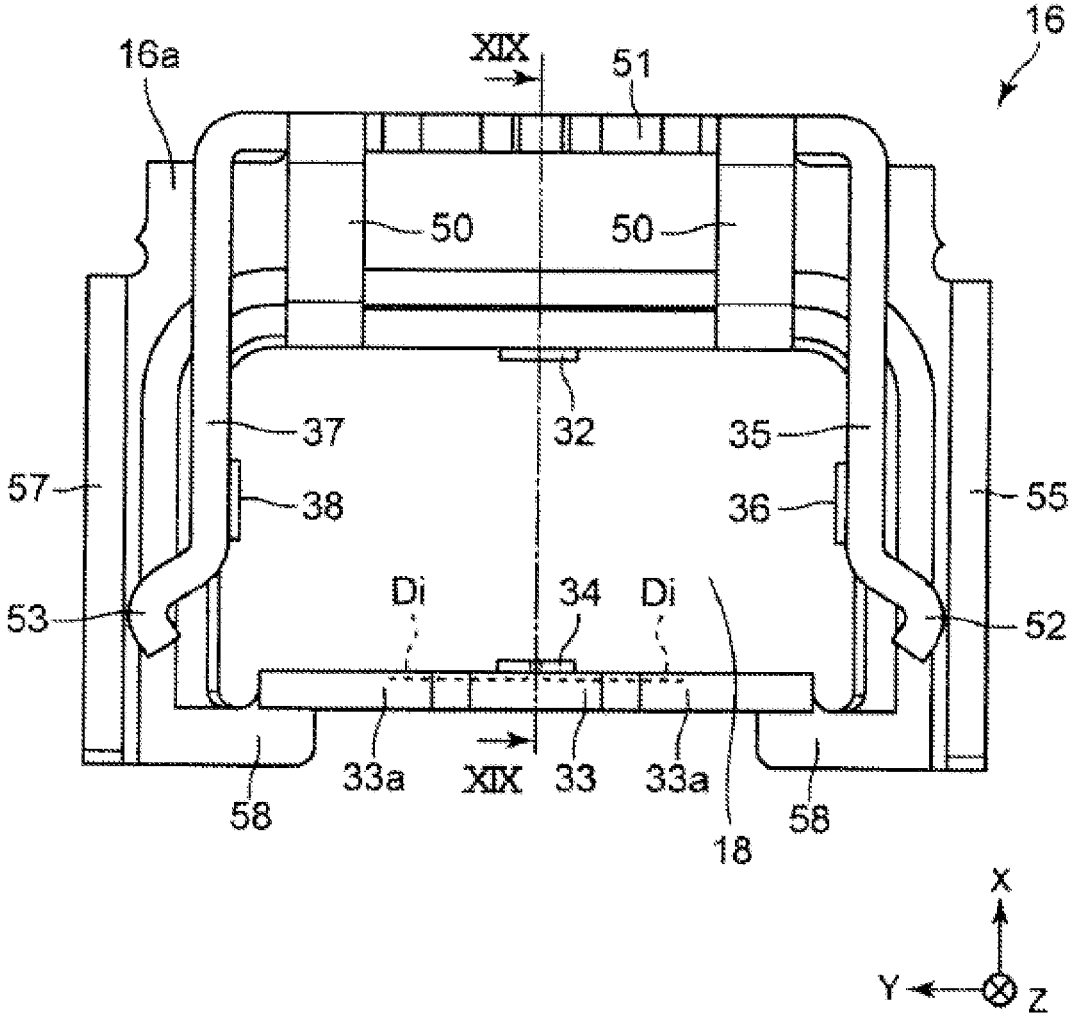
FIG. 18 is a bottom view illustrating a relationship between an inner mounting part and a contact part formed on an inner elastic part in the first external grounding member.
Figure 19:
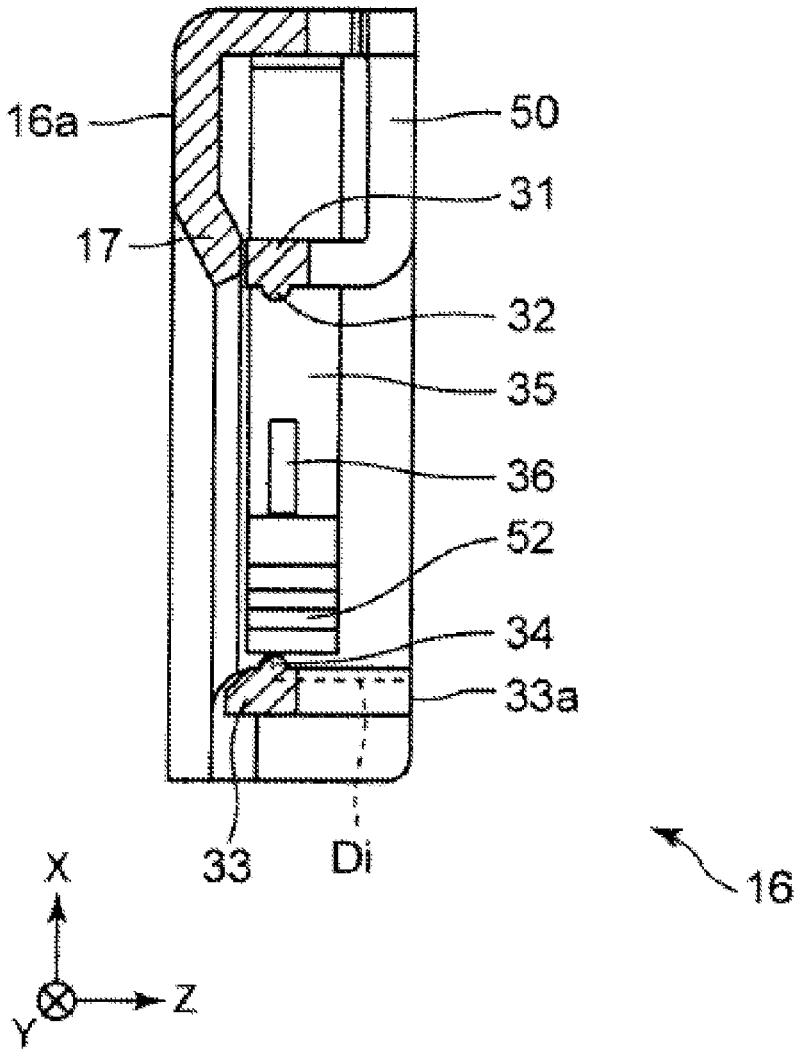
FIG. 19 is a diagram of a cross-sectional structure along line XIX-XIX in FIG. 18 as viewed from the direction Y.

FIG. 16 is a bottom view illustrating a relationship between a first-side mounting part 52*a* and the contact part 36 formed on the first-side elastic part 35 in the first external grounding member 16. FIG. 17 is a diagram of a cross-sectional structure along line XVII-XVII in FIG. 16 as viewed from the direction Y. FIG. 18 is a bottom view illustrating a relationship between the inner mounting parts 33*a* and the contact part 34 formed on an inner elastic part 33 in the first external grounding member 16. FIG. 19 is a diagram of a cross-sectional structure along XIX-XIX line in FIG. 18 as viewed from the direction Y.

As shown in FIGS. 14 and 15, the outer wall 51 extends downward from the guide 17, and the outer elastic part 31 is erected from the two arms 50 and 50 formed at the lower part of the outer wall 51. As a result, the outer elastic part 31 is elastically supported with respect to the outer wall 51 with the two arms 50 and 50 interposed therebetween. Thus, the guide 17 and the outer elastic part 31 are not directly connected. The outer mounting parts 50*a* are formed on lower surfaces of the arms 50. The outer mounting parts 50*a* are used for mounting with the first inner grounding layer 3*a* (shown in FIG. 13) of the first circuit board 3. When the first external grounding member 16 of the first connector 10 is mounted on the first circuit board 3, the outer elastic part 31 functions as an elastic body of a double-end beam having two points of the outer mounting parts 50*a* and 50*a* as fulcrums. The contact part 32 is formed on an inner surface of the outer elastic part 31.

When a force in the X-axis direction acts on the first external grounding member 16 after fitting, the force is received by the guide 17, and the outer elastic part 31 is prevented from being deformed. As a result, the outer elastic part 31 can provide stable spring elasticity, and the contact part 32 can provide reliable and stable contact.

When the first external grounding member 16 is mounted on the first circuit board 3, an outer grounding path Do (shown by a dotted line) connecting the outer mounting part 50*a* and the contact part 32 is a sum of a physical length from the outer mounting part 50*a* to the contact part 32 in the outer elastic part 31 and a protruding height of the contact part 32, which is significantly short. The outer grounding path Do, which is significantly short, can avoid resonance in the outer grounding path Do.

As shown in FIGS. 16 and 17, the outer wall 51 extends downward from the guide 17, and the first-side elastic part 35 formed at a side on the first side of the outer wall 51 extends in the X-axis direction. As a result, the first-side elastic part 35 is elastically supported with respect to the outer wall 51. Thus, the guide 17 and the first-side elastic part 35 are not directly connected. Further, at the time of fitting, the first-side end 52 of the first-side elastic part 35 contacts the inner surface of the first-side wall 55. The first-side mounting part 52*a* is formed on a lower surface of the first-side wall 55. The first-side mounting part 52*a* is used for mounting with the first inner grounding layer 3*a* of the first circuit board 3. When the first connector 10 is mounted on the first circuit board 3 and is fitted to the second connector 20, the first-side elastic part 35 functions as an elastic body of a double-end beam having two points of the first-side mounting part 52*a* and a contact spot on the inner surface of the first-side wall 55 as fulcrums. The contact part 36 is formed on an inner surface of the first-side elastic part 35.

When a force in the Y-axis direction acts on the first external grounding member 16 after fitting, the force is received by the guide 17, and the first-side elastic part 35 is prevented from being deformed. As a result, the first-side elastic part 35 can provide stable spring elasticity, and the contact part 36 can provide reliable and stable contact.

When the first external grounding member 16 is mounted on the first circuit board 3, a first-side grounding path Ds (shown by a dotted line) connecting the first-side mounting part 52*a* and the contact part 36 is a sum of a physical length from the first-side mounting part 52*a* to the contact spot on the inner surface of the first-side wall 55, a physical length of the first-side end 52, a physical length from the first-side end 52 to the contact part 36 in the first-side elastic part 35, and a protruding height of the contact part 36, which is significantly short. The first-side grounding path Ds, which is significantly short, can avoid resonance in the first-side grounding path Ds.

As shown in FIGS. 18 and 19, the inner elastic part 33 is erected from the inner connections 58 formed on an inner side of the first side and an inner side of the second side of the guide 17. As a result, the inner elastic part 33 is elastically supported with respect to the guide 17 with the inner connections 58 interposed therebetween. The inner mounting parts 33*a* are formed on a lower surface of the inner elastic part 33. The inner mounting parts 33*a* are used for mounting with the first inner grounding layer 3*a* of the first circuit board 3. When the first external grounding member 16 of the first connector 10 is mounted on the first circuit board 3, the inner elastic part 33 functions as an elastic body of a double-end beam having two points of the inner mounting parts 33*a* and 33*a* as fulcrums. The contact part 34 is formed on an inner surface of the inner elastic part 33.

The inner elastic part 33 is configured as an elastic body of the double-end beam, and thus the inner elastic part 33 can provide stable spring elasticity and the contact part 34 can provide a reliable and stable contact.

When the first external grounding member 16 is mounted on the first circuit board 3, an inner grounding path Di (shown by a dotted line) connecting the inner mounting part 33*a* and the contact part 34 is a sum of a physical length from the inner mounting part 33*a* to the contact part 34 in the inner elastic part 33 and a protruding height of the contact part 34, which is significantly short. The inner grounding path Di, which is significantly short, can avoid resonance in the inner grounding path Di.

As shown in FIG. 16, the configuration of the second-side elastic part 37 and the second-side wall 57 is symmetrical with respect to the configuration of the first-side elastic part 35 and the first-side wall 55 in the Y-axis direction. Thus, when the first external grounding member 16 is mounted on the first circuit board 3, a second-side grounding path Dt (shown by a dotted line) connecting a second-side mounting part 53*a* and the contact part 38 is a sum of a physical length from the second-side mounting part 53*a* to the contact spot on the inner surface of the second-side wall 57, a physical length of the second-side end 53, a physical length from the second-side end 53 to the contact part 38 in the second-side elastic part 37, and a protruding height of the contact part 38, which is significantly short. The second-side ground path Dt, which is significantly short, can avoid resonance in the second-side grounding path Dt.

[Modification]

Figure 20:
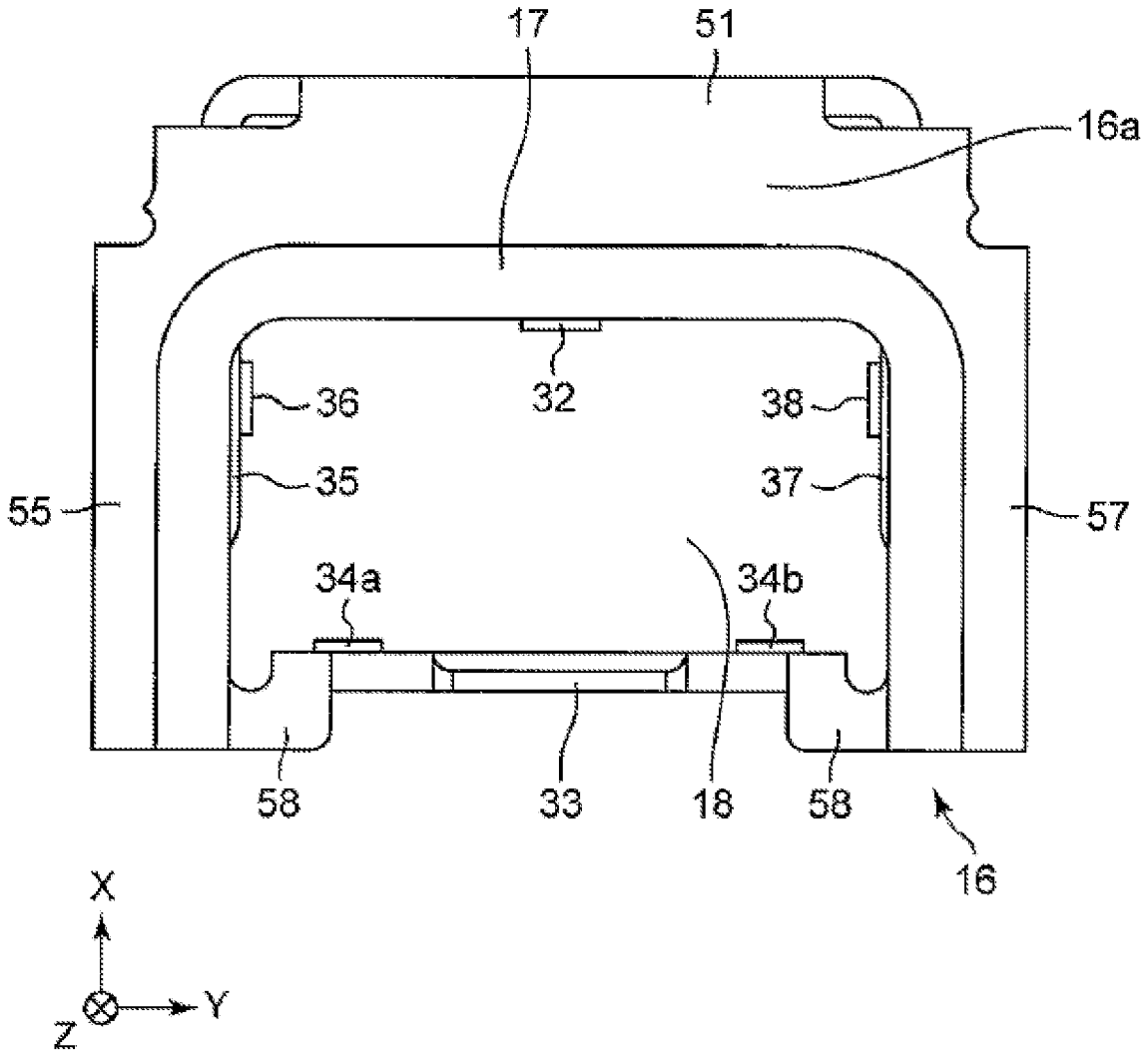
FIG. 20 is a top view of the first external grounding member according to a modification.
Figure 21:
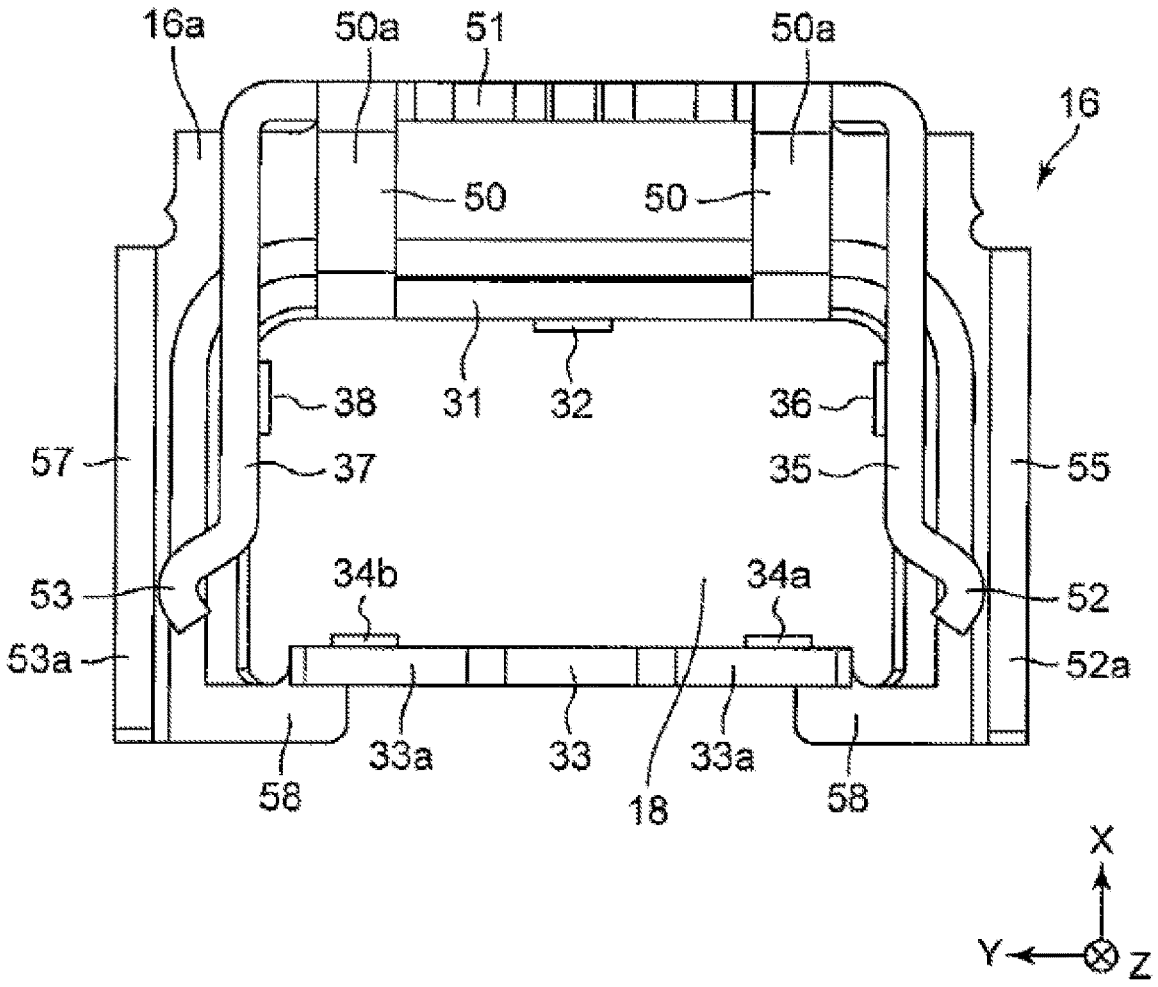
FIG. 21 is a bottom view of the first external grounding member in FIG. 20.

A modification of the contact part in the first external grounding member 16 will be described with reference to FIGS. 20 and 21. FIG. 20 is a top view of the first external grounding member 16 according to the modification. FIG. 21 is a bottom view of the first external grounding member 16 in FIG. 20.

In the above embodiment, in the first external grounding member 16, the contact parts 32, 34, 36, and 38 are provided respectively at each location on side parts configuring a substantially rectangular shape in a plan view from the insertion-extraction direction (Z-axis direction). On the other hand, in the modification shown in FIGS. 20 and 21, contact parts 34*a* and 34*b* at two locations are provided on the side part (inner side part) located on a side facing the first connection terminal 12 (inner side) and extending in the Y-axis direction, that is, on the inner elastic part 33. In this configuration, with more contact parts, when the first external grounding member 16 and the second external grounding member 26 are fitted and connected to each other, one of the members can be prevented from rotating with respect to the other member. Further, the contact parts 34*a* and 34*b* at the two locations are disposed closer to the ends than a central part of the side part (inner side part) disposed on the side facing the first connection terminal 12 (inner side), and thus one of the members can be further prevented from rotating with respect to the other member.

Further, a distance between the contact parts is preferably less than or equal to half of a wavelength of the electromagnetic wave (noise) generated from outside or inside. Such a configuration can reduce an influence of external or internal electromagnetic waves (noise). Thus, the contact parts 34*a* and 34*b* at the two locations are preferably located at lateral positions away from the central part of the side part (inner side part) located on the side facing the first connection terminal 12 (inner side). In other words, the contact parts 34*a* and 34*b* at the two locations are preferably disposed apart from each other so as to sandwich the central part of the inner side part (inner elastic part 33) located on the side (inside) facing the first connection terminal 12. This configuration improves a degree of freedom of each arrangement position of the contact part 36 adjacent to one contact part 34*a* of the contact parts 34*a* and 34*b* at the two locations and the contact part 38 adjacent to the other contact part 34*b* of the contact parts 34*a* and 34*b* at the two locations.

[Another Modification]

Figure 22:
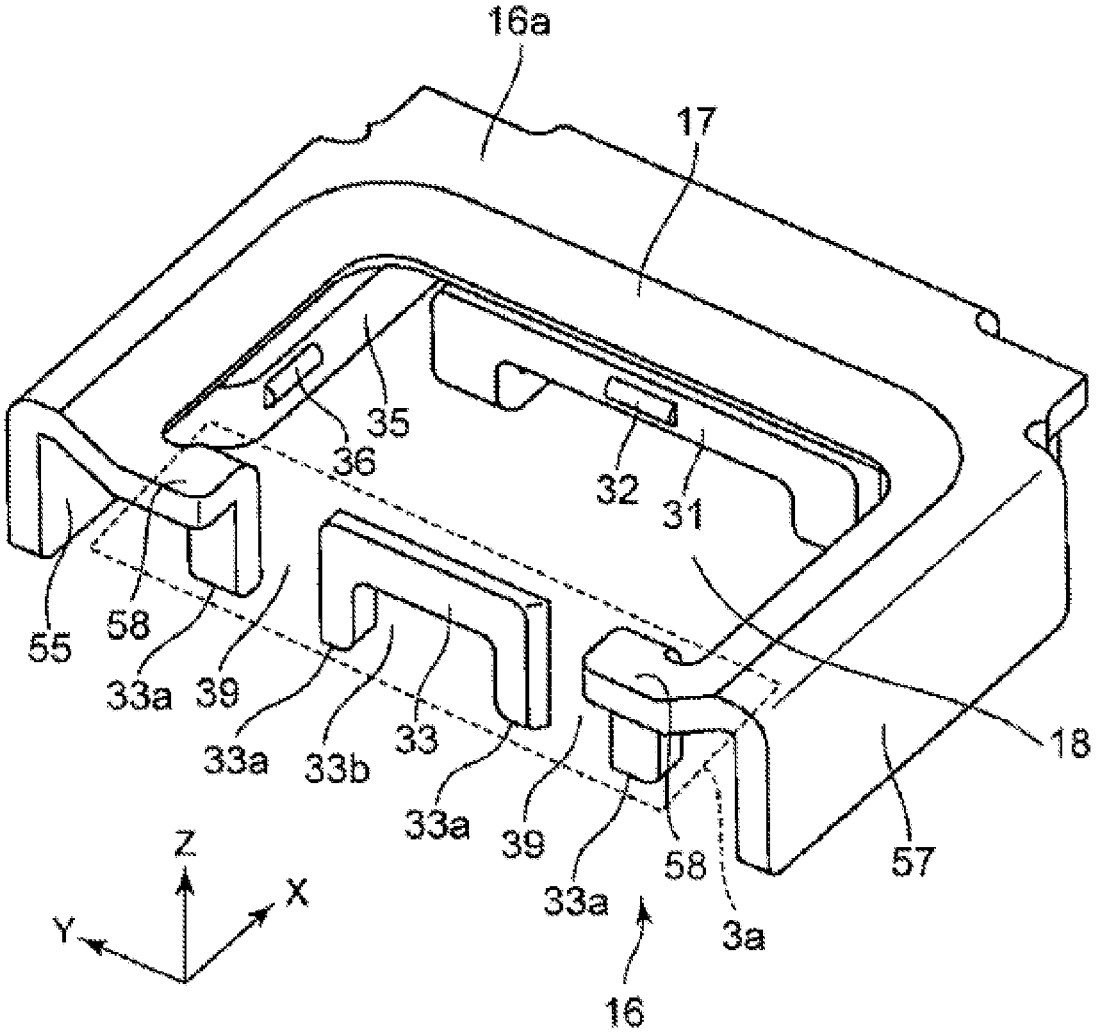
FIG. 22 is a perspective view of the first external grounding member of the first connector according to another modification as viewed from above.

Another modification of the first external grounding member 16 will be described with reference to FIG. 22. FIG. 22 is a perspective view of the first external grounding member 16 of the first connector 10 according to another modification as viewed from above.

In the above embodiment, the first external grounding member 16 is closed in a peripheral shape so as to continuously surround the first high-frequency connection terminal 15 and the second high-frequency connection terminal 25 in a plan view from the insertion-extraction direction (Z-axis direction). On the other hand, in another modification shown in FIG. 22, the first external grounding member 16 does not continuously surround the first high-frequency connection terminal 15 and the second high-frequency connection terminal 25 in a plan view from the insertion-extraction direction (Z-axis direction), and has discontinuous parts 39 and 39 that discontinuously surround the first high-frequency connection terminal 15 and the second high-frequency connection terminal 25. In another modification shown in FIG. 22, the two discontinuous parts 39 and 39 are provided on a side of the inner elastic part 33.

By providing the two discontinuous parts 39 and 39, the first high-frequency connection terminal 15 and the second high-frequency connection terminal 25 and the first connection terminal 12 and the second connection terminal 22 are not fully partitioned (not continuously surrounded) by the first external grounding member 16. In other words, when viewed from a direction in which the first connection terminal 12 and the second connection terminal 22 are aligned (terminal arrangement direction), the first external grounding member 16 has a part electromagnetically shielding the first high-frequency connection terminal 15 and the second high-frequency connection terminal 25 (the inner elastic part 33 and the two inner connections 58). When the first external grounding member 16 has the two discontinuous parts 39 and 39, a shielding capacity is inferior to a shielding capacity when the first external grounding member 16 does not have the two discontinuous parts 39 and 39, but an electromagnetic wave shielding capacity can be demonstrated so as to shield electromagnetic noise entering from outside and electromagnetic noise radiated to outside by the first high-frequency connection terminal 15 and the second high-frequency connection terminal 25. Further, the two discontinuous parts 39 and 39 provided on the first external grounding member 16 provides a function of suppressing physical interference at the time of fitting between the second central support 23 of the second connector 20 and the first external grounding member 16.

The inner elastic part 33 is supported by the first insulating member 11. The two inner mounting parts 33*a* and 33*a* of the inner elastic part 33 and the inner mounting parts 33*a* and 33*a* of the two inner connections 58 and 58 are connected to the first inner grounding layer 3*a* of the first circuit board 3 and grounded. As a result, the inner elastic part 33 and the inner connections 58 can hold substantially the same ground potential.

The contact part 34 is formed between the inner elastic part 33 of the first external grounding member 16 and the second external grounding member 26, and the contact part 34 is disposed on a side facing at least the first connection terminal 12 and the second connection terminal 22. In other words, the contact part 34 is disposed in a region formed between at least one of the first high-frequency connection terminal 15 or the second high-frequency connection terminal 25 and at least one of the first connection terminal 12 or the second connection terminal 22. As a result, an electrical connection to the ground potential is established by the contact part 34 on the side facing the first connection terminal 12 and the second connection terminal 22, and the first high-frequency connection terminal 15 and the second high-frequency connection terminal 25 are electromagnetically shielded.

[Still Another Modification]

Figure 23:
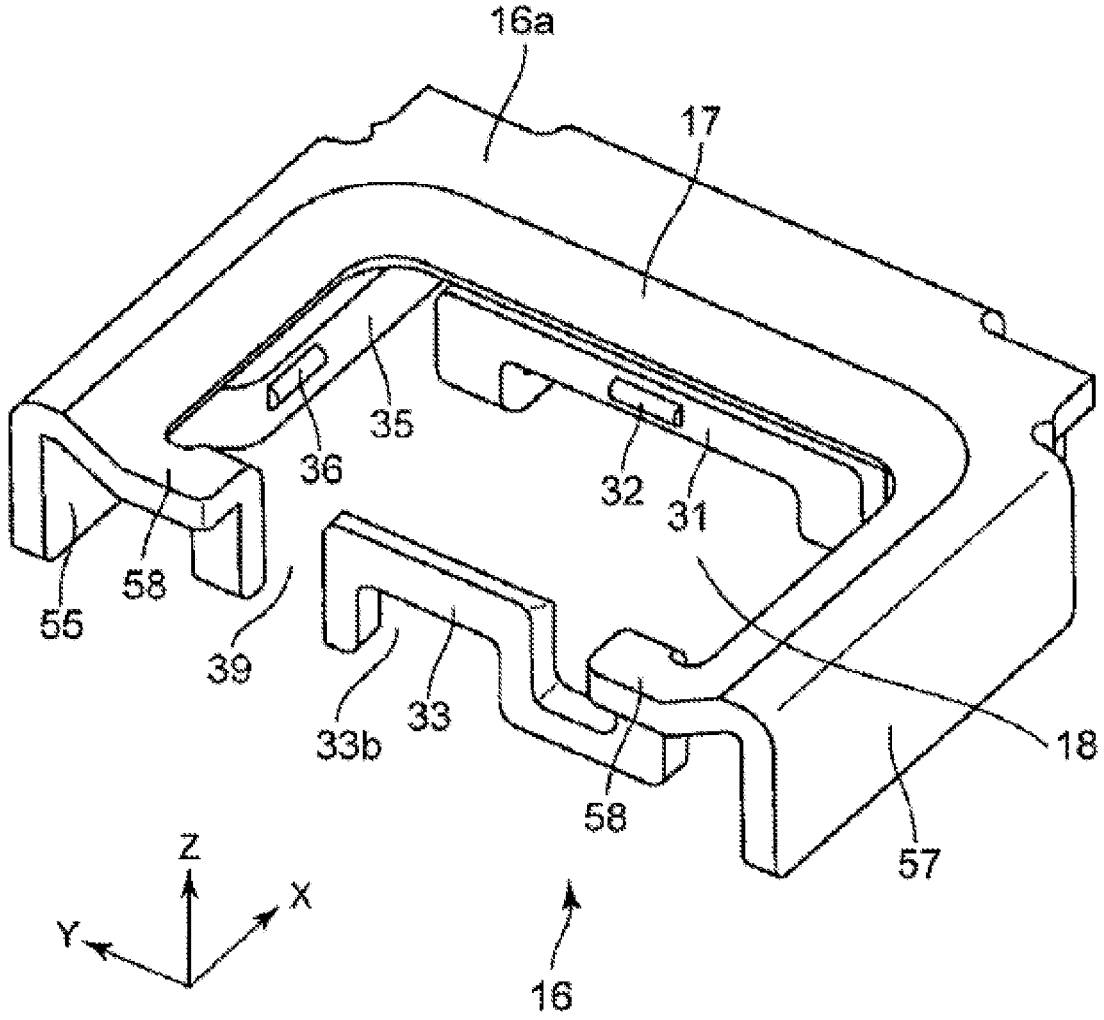
FIG. 23 is a perspective view of the first external grounding member of the first connector according to still another modification as viewed from above.

Still another modification of the first external grounding member 16 will be described with reference to FIG. 23. FIG. 23 is a perspective view of the first external grounding member 16 of the first connector 10 according to still another modification as viewed from above.

In still another modification shown in FIG. 23, the first external grounding member 16 does not continuously surround the first high-frequency connection terminal 15 and the second high-frequency connection terminal 25 in a plan view from the insertion-extraction direction (Z-axis direction), and has the discontinuous part 39 that discontinuously surrounds the first high-frequency connection terminal 15 and the second high-frequency connection terminal 25. In still another modification shown in FIG. 23, the one discontinuous part 39 is provided on the first side of the inner elastic part 33. The inner elastic part 33 is cantileveredly supported by the inner connection 58 on the second side. Further, one discontinuous part 39 may be provided on the second side of the inner elastic part 33, and the inner elastic part 33 may be cantileveredly supported by the inner connection 58 on the first side.

By providing the one discontinuous part 39, the first high-frequency connection terminal 15 and the second high-frequency connection terminal 25 and the first connection terminal 12 and the second connection terminal 22 are not fully partitioned (not continuously surrounded) by the first external grounding member 16. In other words, when viewed from a direction in which the first connection terminal 12 and the second connection terminal 22 are aligned (terminal arrangement direction), the first external grounding member 16 has a part electromagnetically shielding the first high-frequency connection terminal 15 and the second high-frequency connection terminal 25 (the inner elastic part 33 and the two inner connections 58). When the first external grounding member 16 has the one discontinuous part 39, a shielding capacity is inferior to a shielding capacity when the first external grounding member 16 does not have the one discontinuous part 39, but an electromagnetic wave shielding capacity can be demonstrated so as to shield electromagnetic noise entering from outside and electromagnetic noise radiated to outside by the first high-frequency connection terminal 15 and the second high-frequency connection terminal 25.

The contact part 34 is formed between the inner elastic part 33 of the first external grounding member 16 and the second external grounding member 26, and the contact part 34 is disposed on a side facing at least the first connection terminal 12 and the second connection terminal 22. In other words, the contact part 34 is disposed in a region formed between at least one of the first high-frequency connection terminal 15 or the second high-frequency connection terminal 25 and at least one of the first connection terminal 12 or the second connection terminal 22. As a result, an electrical connection is established by the contact part 34 on the side facing the first connection terminal 12 and the second connection terminal 22, and the first high-frequency connection terminal 15 and the second high-frequency connection terminal 25 are electromagnetically shielded.

Although the embodiment of the present disclosure has been described specifically, the present disclosure is not limited to the above embodiment, and various modifications can be made within the scope of the present disclosure.

The present disclosure and the embodiment can be summarized as follows.

An electrical connector set 1 according to one aspect of the present disclosure includes a first connector 10 mounted on a first circuit board 3, and a second connector 20 mounted on a second circuit board 4 and extractably fitted to the first connector 10 in an insertion-extraction direction (Z-axis direction), in which the first connector 10 has a first connection terminal 12, a first high-frequency connection terminal 15 having a first mounting part 19 mounting on the first circuit board 3, and transmitting a high frequency signal having a frequency higher than a signal transmitted by the first connection terminal 12, and a first external grounding member 16 that is a conductor connected to a ground potential and surrounds the first high-frequency connection terminal 15, the second connector 20 has a second connection terminal 22 electrically connected to the first connection terminal 12 at a time of fitting, a second high-frequency connection terminal 25 having a second mounting part 29 mounting on the second circuit board 4 and electrically connected to the first high-frequency connection terminal 15 at the time of fitting, and a second external grounding member 26 that is a conductor connected to the ground potential, surrounds the second high-frequency connection terminal 25, and is electrically connected to the first external grounding member 16 at the time of fitting, and when the first connector 10 and the second connector 20 are fitted to each other, in a plan view from the insertion-extraction direction, the second external grounding member 26 is located on an inner side of the first external grounding member 16, the first connection terminal 12 and the second connection terminal 22 are located on an outer side of the first external grounding member 16, the second external grounding member 26 is closed in a peripheral shape so as to surround the first high-frequency connection terminal 15 and the second high-frequency connection terminal 25, the first mounting part 19 is located on an inner side of the second external grounding member 26, and the second mounting part 29 is located on the inner side of the second external grounding member 26.

In the above configuration, the first high-frequency connection terminal 15 and the second high-frequency connection terminal 25 are surrounded by the second external grounding member 26 closed in a peripheral shape, and the first mounting part 19 and the second mounting part 29 are located on the inner side of the second external grounding member 26, and thus the electromagnetic waves are shielded, and the first high-frequency connection terminal 15 and the second high-frequency connection terminal 25 transmitting high frequency signals can stably transmit signals in a transmission band.

Further, in the electrical connector set 1 according to one embodiment, contact parts 32, 34, 36, and 38 are formed between the first external grounding member 16 and the second external grounding member 26, and the contact part 34 is disposed on a side facing at least the first connection terminal 12 and the second connection terminal 22.

In the above embodiment, an electrical connection is established by the contact part 34 on the side facing at least the first connection terminal 12 and the second connection terminal 22, and the first high-frequency connection terminal 15 and the second high-frequency connection terminal 25 are electromagnetically shielded.

Further, in the electrical connector set 1 according to one embodiment, a plurality of the contact parts 32, 34, 36, and 38 is disposed at least three locations apart from each other in a peripheral direction of the second external grounding member 26 in a plan view from the insertion-extraction direction (Z-axis direction).

The above embodiment can stabilize the electrical connection between the first external grounding member 16 and the second external grounding member 26.

Further, in the electrical connector set 1 according to one embodiment, an inner peripheral part of the first external grounding member 16 has a plurality of side parts 31, 33, 35, and 37, and the contact parts 34*a* and 34*b* at two locations of the plurality of contact parts 32, 34*a*, 34*b*, 36, and 38 at the at least three locations are disposed on one side part 33 of the plurality of side parts 31, 33, 35, and 37.

In the above embodiment, with more contact parts, when the first external grounding member 16 and the second external grounding member 26 are fitted and connected to each other, one of the members can be prevented from rotating with respect to the other member.

Further, in the electrical connector set 1 according to one embodiment, the contacts parts 34*a* and 34*b* at the two locations of the plurality of contact parts on the one side part 33 of the plurality of side parts 31, 33, 35, and 37 configuring the inner peripheral part of the first external grounding member 16 are disposed apart from each other so as to sandwich a central part of the one side part 33 of the plurality of side parts.

The above embodiment improves a degree of freedom of each arrangement position of the contact part 36 adjacent to one contact part 34*a* of the contact parts 34*a* and 34*b* at the two locations and the contact part 38 adjacent to the other contact part 34*b* of the contact parts 34*a* and 34*b* at the two locations.

Further, in the electrical connector set 1 according to one embodiment, the high frequency signal is a millimeter wave signal.

In the above embodiment, the signals can be stably transmitted in the millimeter wave transmission band.

Further, in the electrical connector set 1 according to one embodiment, a peripheral distance of the plurality of the contact parts 32, 34, 36, and 38 is less than or equal to half of a wavelength of the millimeter wave signal in a plan view from the insertion-extraction direction (Z-axis direction).

The above embodiment can suppress leakage of unnecessary radiation in the millimeter wave band through the peripheral distance of the adjacent contact parts 32, 34, 36, and 38.

Further, in the electrical connector set 1 according to one embodiment, in a side view from a side surface direction (X-axis direction) that is orthogonal to the insertion-extraction direction (Z-axis direction) and in which the first connection terminal 12 and the second connection terminal 22 are located, the first high-frequency connection terminal 15 has a non-overlapping part 15*a* that does not overlap with the second external grounding member 26, a lateral cutout part 33*b* that does not overlap with the non-overlapping part 15*a* is disposed in the first external grounding member 16, and a cutout length A in a third direction (Y-axis direction) orthogonal to the insertion-extraction direction (Z-axis direction) and the side surface direction (X-axis direction) in the lateral cutout part 33*b* is less than or equal to half of a wavelength of the millimeter wave signal.

The above embodiment can suppress leakage of unnecessary radiation in the millimeter wave band through the lateral cutout part 33*b*.

Further, in the electrical connector set 1 according to one embodiment, a plurality of the first external grounding members 16 is disposed in the first connector 10, and the first connection terminal 12 is disposed between two of the plurality of first external grounding members 16 and 16.

In the above embodiment, the electromagnetically shielding first external grounding members 16 can suppress interference of the signals between the first connection terminals 12 and one of the first high-frequency connection terminals 15, and between the first connection terminals 12 and the other first high-frequency connection terminals 15.

A circuit board 2 on which the electrical connector set 1 according to one aspect of the present disclosure is mounted includes the electrical connector set 1, the first circuit board 3, and the second circuit board 4, in which in the first circuit board 3, a first inner grounding layer 3*a*, a first insulating layer 3*g*, a first conductive layer 3*b*, a second insulating layer 3*h*, and a first outer grounding layer 3*c* are stacked sequentially from a side facing the first connector 10, and on a side of the first inner grounding layer 3*a*, a first connecting part 3*e* connected to the first mounting part 19 is disposed on the inner side of the second external grounding member 26 in a plan view from the insertion-extraction direction (Z-axis direction), in the second circuit board 4, a second inner grounding layer 4*a*, a third insulating layer 4*g*, a second conductive layer 4*b*, a fourth insulating layer 4*h*, and a second outer grounding layer 4*c* are stacked sequentially from a side facing the second connector 20, and on a side of the second inner grounding layer 4*a*, a second connecting part 4*e* connected to the second mounting part 29 is disposed on the inner side of the second external grounding member 26 in a plan view from the insertion-extraction direction (Z-axis direction), the first connecting part 3*e* is connected to the first conductive layer 3*b* on the inner side of the second external grounding member 26 in a plan view from the insertion-extraction direction (Z-axis direction), and the second connecting part 4*e* is connected to the second conductive layer 4*b* on the inner side of the second external grounding member 26 in a plan view from the insertion-extraction direction (Z-axis direction).

In the above configuration, the first mounting part 19 is electromagnetically shielded by the second external grounding member 26 and the first connecting part 3*e* is electromagnetically shielded by the first inner grounding layer 3*a*, thereby suppressing unnecessary radiation from the first mounting part 19. Further, the second mounting part 29 is electromagnetically shielded by the second external grounding member 26 and the second connecting part 4*e* is electromagnetically shielded by the second inner grounding layer 4*a*, thereby suppressing unnecessary radiation from the second mounting part 29. Therefore, in the circuit board 2 on which the electrical connector set 1 is mounted, the first high-frequency connection terminal 15 and the second high-frequency connection terminal 25 for transmitting high frequency signals can transmit signals stably in the transmission band.

In another aspect, the electrical connector set 1 of the present disclosure includes a first connector 10 mounted on a first circuit board 3, and a second connector 20 mounted on a second circuit board 4 and extractably fitted to the first connector 10 in an insertion-extraction direction (Z-axis direction), in which the first connector 10 has a first connection terminal 12, a first high-frequency connection terminal 15 having a first mounting part 19 mounting on the first circuit board 3, and transmitting a high frequency signal having a frequency higher than a signal transmitted by the first connection terminal 12, and a first external grounding member 16 that is a conductor connected to a ground potential and surrounds the first high-frequency connection terminal 15, the second connector 20 has a second connection terminal 22 electrically connected to the first connection terminal 12 at a time of fitting, a second high-frequency connection terminal 25 having a second mounting part 29 mounting on the second circuit board 4 and electrically connected to the first high-frequency connection terminal 15 at the time of fitting, and a second external grounding member 26 that is a conductor connected to the ground potential, surrounds the second high-frequency connection terminal 25, and is electrically connected to the first external grounding member 16 at the time of fitting, and when the first connector 10 and the second connector 20 are fitted to each other, in a plan view from the insertion-extraction direction, the second external grounding member 26 is located on an inner side of the first external grounding member 16, the first connection terminal 12 and the second connection terminal 22 are located on an outer side of the first external grounding member 16, the first external grounding member 16 has a discontinuous part 39 discontinuously surrounding the first high-frequency connection terminal 15 and the second high-frequency connection terminal 25, the first mounting part 19 is located on an inner side of the second external grounding member 26, and the second mounting part 29 is located on the inner side of the second external grounding member 26.

In the above embodiment, a shielding capacity is inferior to a shielding capacity when the first external grounding member 16 does not have the discontinuous part 39, but an electromagnetic wave shielding capacity can be demonstrated so as to shield electromagnetic noise entering from outside and electromagnetic noise radiated to outside by the first high-frequency connection terminal 15 and the second high-frequency connection terminal 25.

Further, in the electrical connector set 1 according to one embodiment, the second external grounding member 26 is provided with a cutout part 49 in a plan view from the insertion-extraction direction, and the cutout part 49 is surrounded by the first external grounding member 16 at the time of fitting.

In the above configuration, unnecessary radiation from the first high-frequency connection terminal 15 and a second high-frequency connection terminal 25 can be suppressed while adjusting the fitting strength.

Further, in the electrical connector set 1 according to one embodiment, in the first external grounding member 16, an inner elastic part 33 and an inner connection 58 that are discontinuous by the discontinuous part 39 are connected to a first inner grounding layer 3*a* of the first circuit board 3 and grounded.

In the above configuration, the inner elastic part 33 and the inner connections 58 can hold substantially the same ground potential.

What is claimed is:

1. An electrical connector set comprising:

a first connector mounted on a first circuit board, the first connector having a first connection terminal, a first high-frequency connection terminal having a first mounting part mounting on the first circuit board and transmitting a high frequency signal having a frequency higher than a signal transmitted by the first connection terminal, and at least two first external grounding members that, in combination, surround a periphery of the first connector, wherein at least one of the first external grounding members is a conductor connected to a ground potential and surrounds the first high-frequency connection terminal; and a second connector mounted on a second circuit board and extractably fitted to the first connector in an insertion-extraction direction, the second connector having a second connection terminal electrically connected to the first connection terminal at a time of fitting, a second high-frequency connection terminal having a second mounting part mounting on the second circuit board and electrically connected to the first high-frequency connection terminal at the time of fitting, and a second external grounding member that is a conductor connected to the ground potential when the first connector and the second connector are fitted to each other, surrounds the second high-frequency connection terminal, and is electrically connected to the at least one first external grounding member at the time of fitting, and when the first connector and the second connector are fitted to each other, in a plan view from the insertion-extraction direction, the second external grounding member is located on an inner side of the at least one first external grounding member, the first connection terminal and the second connection terminal are located on an outer side of the at least one first external grounding member, the second external grounding member is closed in a peripheral shape so as to surround a periphery of the first high-frequency connection terminal and a periphery of the second high-frequency connection terminal.

2. The electrical connector set according to claim 1, wherein when the first connector and the second connector are fitted to each other, at least one contact part is between the at least one first external grounding member and the second external grounding member, and the contact part is disposed on a side facing at least the first connection terminal and the second connection terminal.

3. The electrical connector set according to claim 2, wherein a plurality of the contact parts is disposed at at least three locations apart from each other in a peripheral direction of the second external grounding member in a plan view from the insertion-extraction direction.

4. The electrical connector set according to claim 3, wherein an inner peripheral part of the at least one first external grounding member has a plurality of side parts, and the contact parts at two locations of the plurality of contact parts at the at least three locations are disposed on one side part of the plurality of side parts.

5. The electrical connector set according to claim 4, wherein the contact parts at the two locations on the one side part of the plurality of side parts configuring the inner peripheral part of the at least one first external grounding member are disposed apart from each other so as to sandwich a central part of the one side part of the plurality of side parts.

6. The electrical connector set according to claim 1, wherein the high frequency signal is a millimeter wave signal.

7. The electrical connector set according to claim 6, wherein contact parts are disposed between the at least one first external grounding member and the second external grounding member, and a peripheral distance of the contact parts is less than or equal to half of a wavelength of the millimeter wave signal in a plan view from the insertion-extraction direction.

8. The electrical connector set according to claim 6, wherein in a side view from a side surface direction that is orthogonal to the insertion-extraction direction and in which the first connection terminal and the second connection terminal are located, the first high-frequency connection terminal has a non-overlapping part that does not overlap with the second external grounding member, a lateral cutout part that does not overlap with the non-overlapping part is disposed in the at least one first external grounding member, and a cutout length in a third direction orthogonal to the insertion-extraction direction and the side surface direction in the lateral cutout part is less than or equal to half of a wavelength of the millimeter wave signal.

9. The electrical connector set according to claim 1, wherein a plurality of the at least one first external grounding members is disposed in the first connector, and the first connection terminal is disposed between two of the plurality of first external grounding members.

10. A circuit board on which the electrical connector set according to claim 1 is mounted, the circuit board comprising:

the electrical connector set;

the first circuit board, which includes a first inner grounding layer, a first insulating layer, a first conductive layer, a second insulating layer, and a first outer grounding layer are stacked sequentially from a side facing the first connector, and on a side of the first inner grounding layer, and a first connecting part connected to the first mounting part is disposed on the inner side of the second external grounding member in a plan view from the insertion-extraction direction;

the second circuit board, which includes a second inner grounding layer, a third insulating layer, a second conductive layer, a fourth insulating layer, and a second outer grounding layer stacked sequentially from a side facing the second connector, and on a side of the second inner grounding layer, and a second connecting part connected to the second mounting part is disposed on the inner side of the second external grounding member in a plan view from the insertion-extraction direction, wherein the first connecting part is connected to the first conductive layer on the inner side of the second external grounding member in a plan view from the insertion-extraction direction, and the second connecting part is connected to the second conductive layer on the inner side of the second external grounding member in a plan view from the insertion-extraction direction.

11. The electrical connector set according to claim 2, wherein the high frequency signal is a millimeter wave signal.

12. The electrical connector set according to claim 3, wherein the high frequency signal is a millimeter wave signal.

13. The electrical connector set according to claim 2, wherein a plurality of the at least one first external grounding members is disposed in the first connector, and the first connection terminal is disposed between two of the plurality of first external grounding members.

14. The electrical connector set according to claim 3, wherein a plurality of the at least one first external grounding members is disposed in the first connector, and the first connection terminal is disposed between two of the plurality of first external grounding members.

15. A circuit board on which the electrical connector set according to claim 2 is mounted, the circuit board comprising:

the electrical connector set;

the first circuit board, which includes a first inner grounding layer, a first insulating layer, a first conductive layer, a second insulating layer, and a first outer grounding layer are stacked sequentially from a side facing the first connector, and on a side of the first inner grounding layer, and a first connecting part connected to the first mounting part is disposed on the inner side of the second external grounding member in a plan view from the insertion-extraction direction;

the second circuit board, which includes a second inner grounding layer, a third insulating layer, a second conductive layer, a fourth insulating layer, and a second outer grounding layer stacked sequentially from a side facing the second connector, and on a side of the second inner grounding layer, and a second connecting part connected to the second mounting part is disposed on the inner side of the second external grounding member in a plan view from the insertion-extraction direction, wherein the first connecting part is connected to the first conductive layer on the inner side of the second external grounding member in a plan view from the insertion-extraction direction, and the second connecting part is connected to the second conductive layer on the inner side of the second external grounding member in a plan view from the insertion-extraction direction.

16. A circuit board on which the electrical connector set according to claim 3 is mounted, the circuit board comprising:

the electrical connector set;

the first circuit board, which includes a first inner grounding layer, a first insulating layer, a first conductive layer, a second insulating layer, and a first outer grounding layer are stacked sequentially from a side facing the first connector, and on a side of the first inner grounding layer, and a first connecting part connected to the first mounting part is disposed on the inner side of the second external grounding member in a plan view from the insertion-extraction direction;

the second circuit board, which includes a second inner grounding layer, a third insulating layer, a second conductive layer, a fourth insulating layer, and a second outer grounding layer stacked sequentially from a side facing the second connector, and on a side of the second inner grounding layer, and a second connecting part connected to the second mounting part is disposed on the inner side of the second external grounding member in a plan view from the insertion-extraction direction, wherein the first connecting part is connected to the first conductive layer on the inner side of the second external grounding member in a plan view from the insertion-extraction direction, and the second connecting part is connected to the second conductive layer on the inner side of the second external grounding member in a plan view from the insertion-extraction direction.

17. An electrical connector set comprising:

a first connector mounted on a first circuit board, the first connector having a first connection terminal, a first high-frequency connection terminal having a first mounting part mounting on the first circuit board and transmitting a high frequency signal having a frequency higher than a signal transmitted by the first connection terminal, and at least two first external grounding members that, in combination, surround a periphery of the first connector, wherein at least one of the first external grounding members is a conductor connected to a ground potential and surrounds the first high-frequency connection terminal; and a second connector mounted on a second circuit board and extractably fitted to the first connector in an insertion-extraction direction, the second connector having a second connection terminal electrically connected to the first connection terminal at a time of fitting, a second high-frequency connection terminal having a second mounting part mounting on the second circuit board and electrically connected to the first high-frequency connection terminal at the time of fitting, and a second external grounding member that is a conductor connected to the ground potential, surrounds the second high-frequency connection terminal, and is electrically connected to the at least one first external grounding member at the time of fitting, and when the first connector and the second connector are fitted to each other, in a plan view from the insertion-extraction direction, the second external grounding member is located on an inner side of the at least one first external grounding member, and the first connection terminal and the second connection terminal are located on an outer side of the at least one first external grounding member, the at least one first external grounding member has a discontinuous part discontinuously surrounding the first high-frequency connection terminal and the second high-frequency connection terminal, and the second external grounding member surrounds a periphery of the first high-frequency connection terminal and a periphery of the second high-frequency connection terminal.

18. The electrical connector set according to claim 17, wherein the second external grounding member is provided with a cutout part in a plan view from the insertion-extraction direction, and the cutout part is surrounded by the at least one first external grounding member at the time of fitting.

19. The electrical connector set according to claim 17, wherein in the at least one first external grounding member, an inner elastic part and an inner connection that are discontinuous by the discontinuous part are connected to a first inner grounding layer of the first circuit board and grounded.

20. The electrical connector set according to claim 18, wherein in the at least one first external grounding member, an inner elastic part and an inner connection that are discontinuous by the discontinuous part are connected to a first inner grounding layer of the first circuit board and grounded.

* * * * *